US009766587B2

(12) United States Patent
Hiramatsu et al.

(10) Patent No.: US 9,766,587 B2
(45) Date of Patent: Sep. 19, 2017

(54) IMAGE FORMING APPARATUS AND CARTRIDGE USED THEREIN

(71) Applicant: CANON KABUSHIKI KAISHA, Tokyo (JP)

(72) Inventors: Daisuke Hiramatsu, Tokyo (JP); Tomonori Mori, Numazu (JP); Ken Kikuchi, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/156,600

(22) Filed: May 17, 2016

(65) Prior Publication Data

US 2016/0342133 A1 Nov. 24, 2016

(30) Foreign Application Priority Data

May 21, 2015 (JP) ..... 2015-103558

(51) Int. Cl.
*G03G 15/08* (2006.01)
*G03G 21/16* (2006.01)

(52) U.S. Cl.
CPC ..... *G03G 21/1676* (2013.01); *G03G 15/0865* (2013.01); *G03G 15/0879* (2013.01); *G03G 21/1633* (2013.01); *G03G 21/1647* (2013.01)

(58) Field of Classification Search
USPC ..... 399/107, 110, 111, 119, 120, 252, 258, 399/262
See application file for complete search history.

(56) References Cited

U.S. PATENT DOCUMENTS

| | | | |
|---|---|---|---|
| 6,507,720 | B2 | 1/2003 | Kabumoto et al. |
| 7,983,597 | B2 | 7/2011 | Kikuchi |
| 8,073,360 | B2 | 12/2011 | Kikuchi |
| 8,185,013 | B2 | 5/2012 | Kikuchi et al. |
| 8,406,657 | B2 | 3/2013 | Kikuchi et al. |
| 8,412,070 | B2 | 4/2013 | Kikuchi et al. |
| 8,467,701 | B2 | 6/2013 | Kikuchi et al. |
| 8,509,650 | B2 | 8/2013 | Kikuchi et al. |
| 8,526,848 | B2 | 9/2013 | Nishiuwatoko et al. |
| 8,626,025 | B2 | 1/2014 | Kikuchi et al. |
| 8,639,158 | B2 | 1/2014 | Kikuchi et al. |

(Continued)

FOREIGN PATENT DOCUMENTS

| | | |
|---|---|---|
| JP | 2002-099130 A | 4/2002 |
| JP | 2010-134023 A | 6/2010 |

*Primary Examiner* — Hoan Tran
(74) *Attorney, Agent, or Firm* — Fitzpatrick, Cella, Harper & Scinto

(57) ABSTRACT

An image forming apparatus includes a main assembly and a cartridge. The main assembly includes a mounting portion for mounting the cartridge and a door for causing the mounting portion to be in an open state and a closed state. The main assembly or the cartridge includes an expansion and contraction member for displacing at least a part of the cartridge. Opening and closing of the door is interrelated with expansion and contraction of the expansion and contraction member. In the closed state, the cartridge mounted in the mounting portion is in a first position, inside the main assembly, where an image is formable. In the open state, the cartridge mounted in the mounting portion is in a second position where at least a part thereof projects to an outside of the main assembly.

20 Claims, 27 Drawing Sheets

(56) References Cited

U.S. PATENT DOCUMENTS

| | | | | |
|---|---|---|---|---|
| 8,666,278 | B2 | 3/2014 | Hiramatsu et al. | |
| 8,682,212 | B2 | 3/2014 | Kikuchi et al. | |
| 8,737,872 | B2 | 5/2014 | Hiratmatsu et al. | |
| 8,824,919 | B2 | 9/2014 | Kikuchi | |
| 8,855,531 | B2 | 10/2014 | Suzuki et al. | |
| 8,983,334 | B2 | 3/2015 | Hiramatsu et al. | |
| 9,014,596 | B2 | 4/2015 | Kikuchi et al. | |
| 9,037,039 | B2 | 5/2015 | Kikuchi et al. | |
| 9,256,197 | B2 | 2/2016 | Kikuchi | |
| 9,429,872 | B2 * | 8/2016 | Nakajima ..... | G03G 15/0874 |
| 2002/0009310 | A1 | 1/2002 | Kabumoto et al. | |
| 2010/0135691 | A1 | 6/2010 | Kikuchi | |
| 2011/0249985 | A1 | 10/2011 | Kikuchi | |
| 2014/0369714 | A1 | 12/2014 | Suzuki et al. | |
| 2015/0192890 | A1 | 7/2015 | Kikuchi et al. | |

* cited by examiner

IMAGE FORMING APPARATUS AND CARTRIDGE USED THEREIN

FIELD OF THE INVENTION AND RELATED ART

The present invention relates to an image forming apparatus and a cartridge used therein and is suitable for the image forming apparatus, such as a copying machine or a printer, employing an electrophotographic recording process or an electrostatic recording process.

Conventionally, in an electrophotographic image forming apparatus using an electrophotographic image forming process, a cartridge type in which process means and the like are provided as a unit so as to be exchangeable from an apparatus main assembly portion of the image forming apparatus is employed. As a cartridge employing the cartridge type, there is a developing cartridge including a developing roller and the like. Further, as the cartridge employing the cartridge type, there is a process cartridge in which an electrophotographic photosensitive drum and process means actable on the photosensitive drum are integrally assembled into a cartridge. The process cartridge may also be prepared by providing a photosensitive member integrally with the developing cartridge including the developing roller as the process means.

Further, there is a toner cartridge type in which a toner cartridge capable of supplying toner (developer) is provided detachably mountable to the developing cartridge including the developing roller and the like or an image forming apparatus main assembly. The toner cartridge can be exchanged separately from another part (component), such as the photosensitive drum or the developing roller, constituting the developing cartridge or the image forming apparatus main assembly. For that reason, the toner cartridge is effective in the case where consumption of the toner accommodated in a toner accommodating unit and a life cycle of another part, such as the photosensitive drum or the developing roller, constituting the developing cartridge or the image forming apparatus main assembly are different from each other.

In such a toner cartridge type, such a constitution that the toner cartridge is partly exposed from a toner cartridge mounting portion of the image forming apparatus main assembly and a user grips an exposed portion when the toner cartridge is exchanged and thus exchange of the toner cartridge is facilitated has been known (Japanese Laid-Open Patent Application (JP-A) 2002-99130).

Further, such a constitution that the toner cartridge includes a grip portion which is partly exposed from a toner cartridge mounting portion of the image forming apparatus main assembly and a user grips the grip portion when the toner cartridge is exchanged and thus exchange of the toner cartridge is facilitated has been known (JP-A 2010-134023).

However, in JP-A 2002-99130, when a new cartridge for exchange is mounted, due to absence of a cartridge mounting portion at a shallow position inside an apparatus main assembly, there was a need that the user gripped the toner cartridge and then reached into the image forming apparatus main assembly with a hand.

Further, in JP-A 2010-134023, depending on a direction of the grip portion when a door was closed, the grip portion was not rotated when the door was opened and therefore there was a need that the user reached into the image forming apparatus main assembly with a hand and rotated the grip portion and then exchanged the cartridge while gripping the grip portion. Further, a self-weight of the grip portion itself was used, and therefore the cartridge exchange was realizable when a pulling-out direction of the cartridge was a horizontal direction, but was unrealizable when the pulling-out direction of the cartridge was a vertical direction.

SUMMARY OF THE INVENTION

A principal object of the present invention is to provide an image forming apparatus capable of exchanging a cartridge with no need that a user reaches into an image forming apparatus main assembly with a hand.

Another object of the present invention is to provide a cartridge used in the image forming apparatus.

According to an aspect of the present invention, there is provided an image forming apparatus comprising: a main assembly; and a cartridge capable of supplying developer and detachably mountable to the main assembly, wherein the main assembly includes a mounting portion for mounting the cartridge and a door for causing the mounting portion to be in an open state and a closed state, wherein the main assembly or the cartridge includes an expansion and contraction member for displacing at least a part of the cartridge, wherein opening and closing of the door is interrelated with expansion and contraction of the expansion and contraction member, wherein in the closed state, the cartridge mounted in the mounting portion is in a first position, inside the main assembly, where an image is formable, and wherein in the open state, the cartridge mounted in the mounting portion is in a second position where at least a part thereof projects to an outside of the main assembly.

According to another aspect of the present invention, there is provided a cartridge capable of supplying developer and detachably mountable to a main assembly of an image forming apparatus including a mounting portion and a door for causing the mounting portion to be in an open state and a closed state, the cartridge comprising: a grip portion; and an expansion and contraction member for displacing the grip portion while maintaining the cartridge at a position where the cartridge is mounted in the mounting portion, wherein the grip portion is in a first position where an image is formable inside the main assembly in the closed state and is in a second position where the grip portion projects to an outside of the main assembly in the open state.

Further features of the present invention will become apparent from the following description of exemplary embodiments with reference to the attached drawings.

DESCRIPTION OF THE EMBODIMENTS

Embodiments according to the present invention will be described with reference to the drawings. However, dimensions, materials, shapes and relative arrangement of constituent elements described in the following embodiments are not intended such that the scope of the present invention is limited only thereto unless otherwise specified.

<First Embodiment>

(Image Forming Apparatus)

Figure 1:
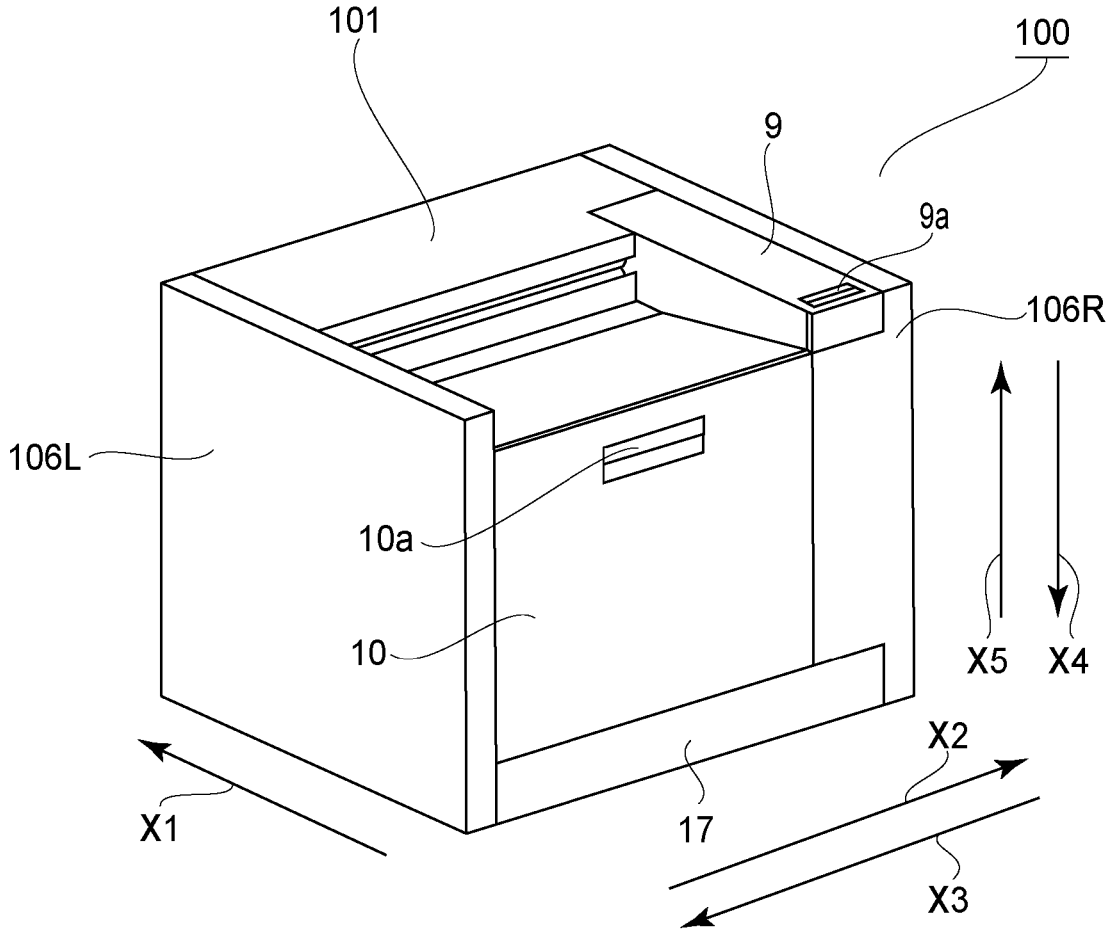
FIG. 1 is a perspective view of an outer appearance of an image forming apparatus according to a First Embodiment.
Figure 4A:
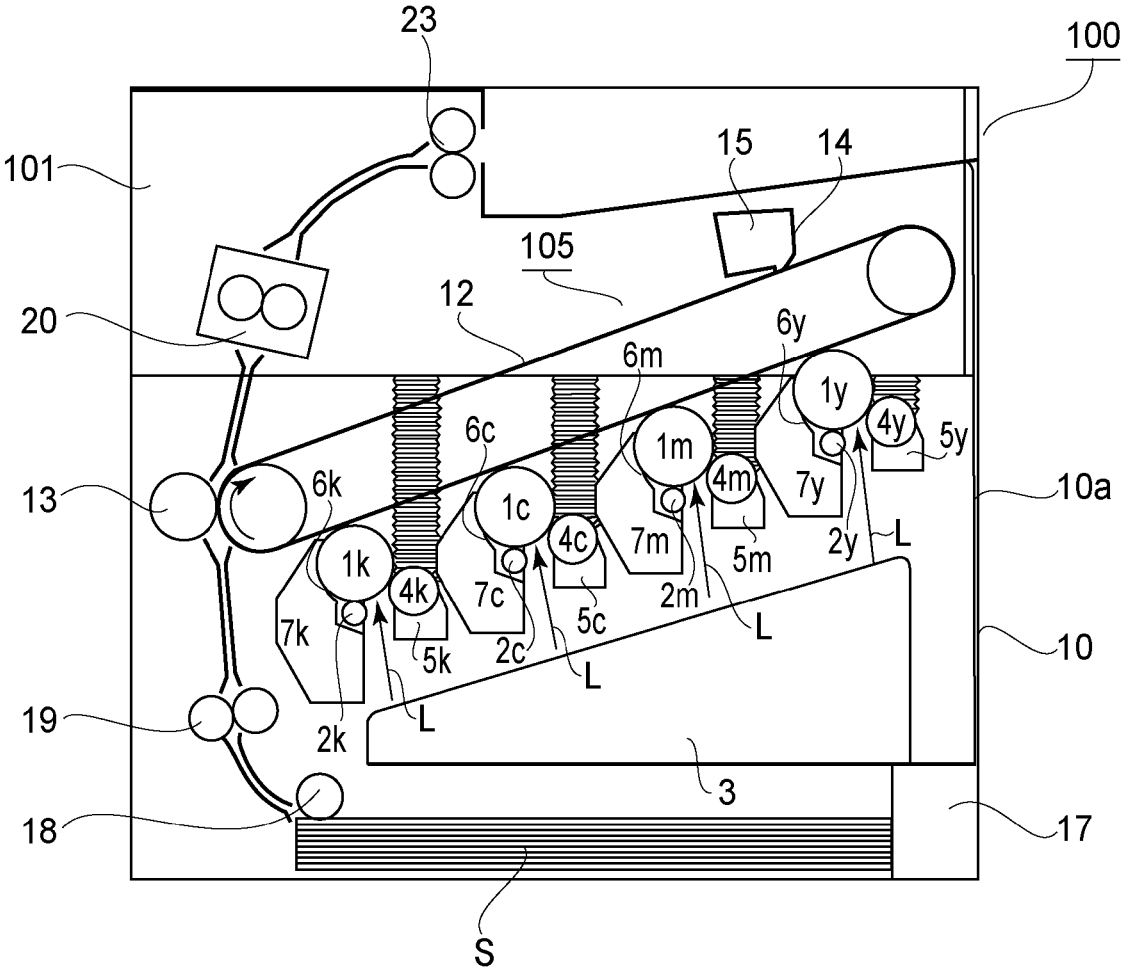
FIG. 4A is a sectional view, from a left side direction, showing the image forming apparatus.

As shown in FIG. 1 and FIG. 4A, an image forming apparatus 100 is a four-color-based full-color laser (beam) printer using an electrophotographic process. That is, the image forming apparatus 100 executes image formation on a sheet-shaped recording material (medium) S on the basis of an electrical image signal inputted from a host device (not shown) such as a personal computer, an image reader or a remote-side facsimile machine into a control circuit portion (not shown).

Here, with respect to the image forming apparatus 100, a front side or a front surface side is a side having a door 10 for opening and closing of the image forming apparatus. A rear side is a side opposite from the front (surface) side. A front-rear direction includes a direction (rearward direction, X1) from the front side to the rear side of the image forming apparatus and a direction (forward direction) opposite to the rearward direction (X1). Left and right (sides) are those when the image forming apparatus 100 is seen from the front side.

Further, a left-right direction includes a direction (rightward direction, X2) from left to right and a direction (leftward direction, X3) opposite to the rightward direction (X2). Upward (above) and downward (below) are those when the image forming apparatus is seen from the front side. Further, an up-down direction includes a direction (downward direction, X4) from above to below and includes a direction (upward direction, X5) from below to above. An image forming apparatus main assembly 101 is an image forming apparatus main assembly portion which is a portion where toner cartridges 8 (8*y*, 8*m*, 8*c*, 8*k*) are removed from the image forming apparatus 100.

As shown in FIG. 4A, the apparatus main assembly 101 includes photosensitive drums 1 (1*y*, 1*m*, 1*c*, 1*k*). The photosensitive drums 1 are electrically charged at surfaces thereof by chargers 2 (2*y*, 2*m*, 2*c*, 2*k*) and are exposed to laser light L, on the basis of image information, by an exposure device 3, so that electrostatic images are formed.

The electrostatic latent images are developed as toner images by developing devices (4*y*, 4*m*, 4*c*, 4*k*) with toners (developers), of respective colors of yellow, magenta, cyan, black, supplied from toner accommodating portions 5 (5*y*, 5*m*, 5*c*, 5*k*). The toner images obtained by developing the electrostatic latent images are primary-transferred onto an intermediary transfer belt 12 of an intermediary transfer unit 105. Transfer residual toners remaining on the photosensitive drums 1 after the primary transfer are removed by drum cleaning devices 6 (6*y*, 6*m*, 6*c*, 6*k*) and then are accommodated in residual toner containers 7 (7*y*, 7*m*, 7*c*, 7*k*).

On the other hand, a sheet S as a recording material stacked in a feeding cassette 17 is fed to a nip between a secondary transfer roller 13 and the intermediary transfer belt 12 by a feeding roller 18 and a registration roller pair 19, so that the toner images primary-transferred on the intermediary transfer belt 12 are secondary-transferred onto the sheet S. The sheet S on which the toner images are transferred is subjected to fixing of the toner images thereon by a fixing device 20, and then is discharged to an outside of the apparatus main assembly by a discharging roller pair 23. A transfer residual toner remaining on the intermediary transfer belt 12 after the secondary transfer is removed by a belt cleaning device 14, and then is accommodated in a residual toner container 15.

Figure 4B:
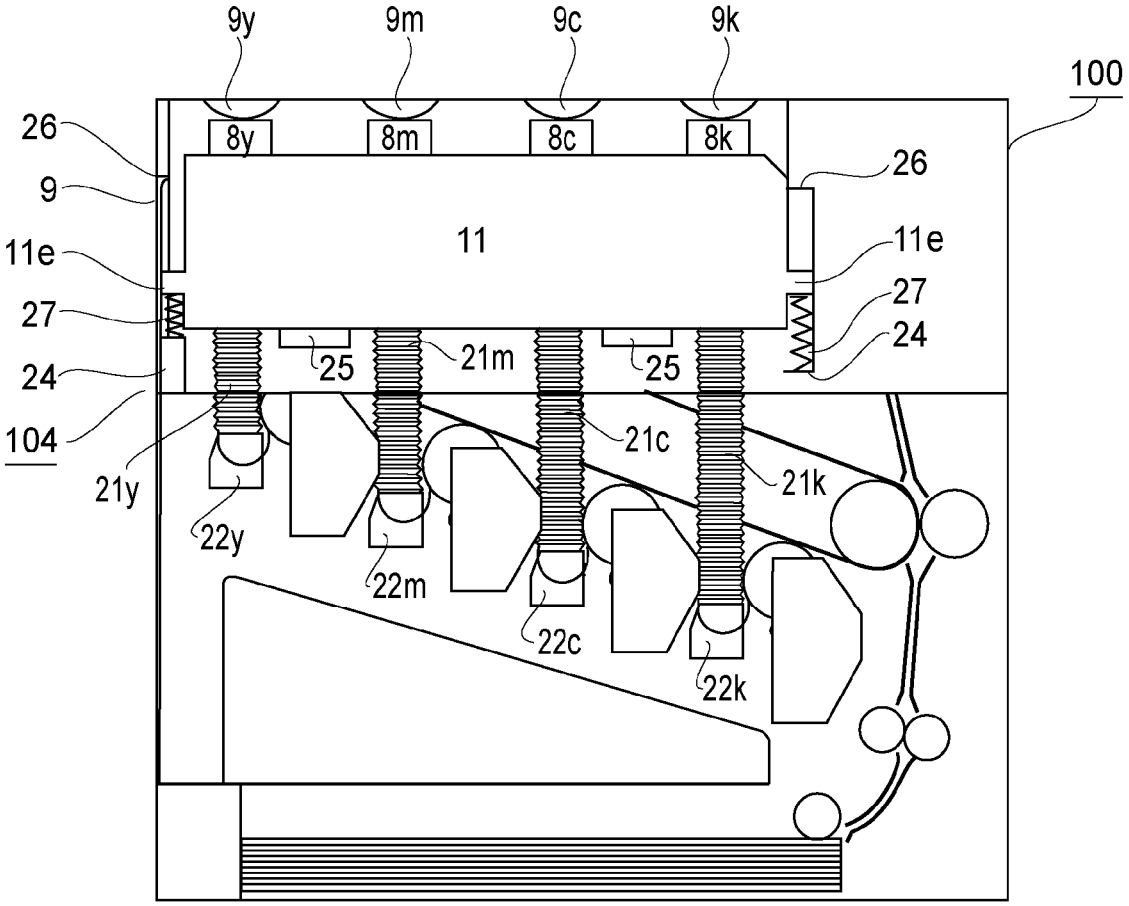
FIG. 4B is a sectional view, from the right side direction, showing the image forming apparatus.
Figure 6:
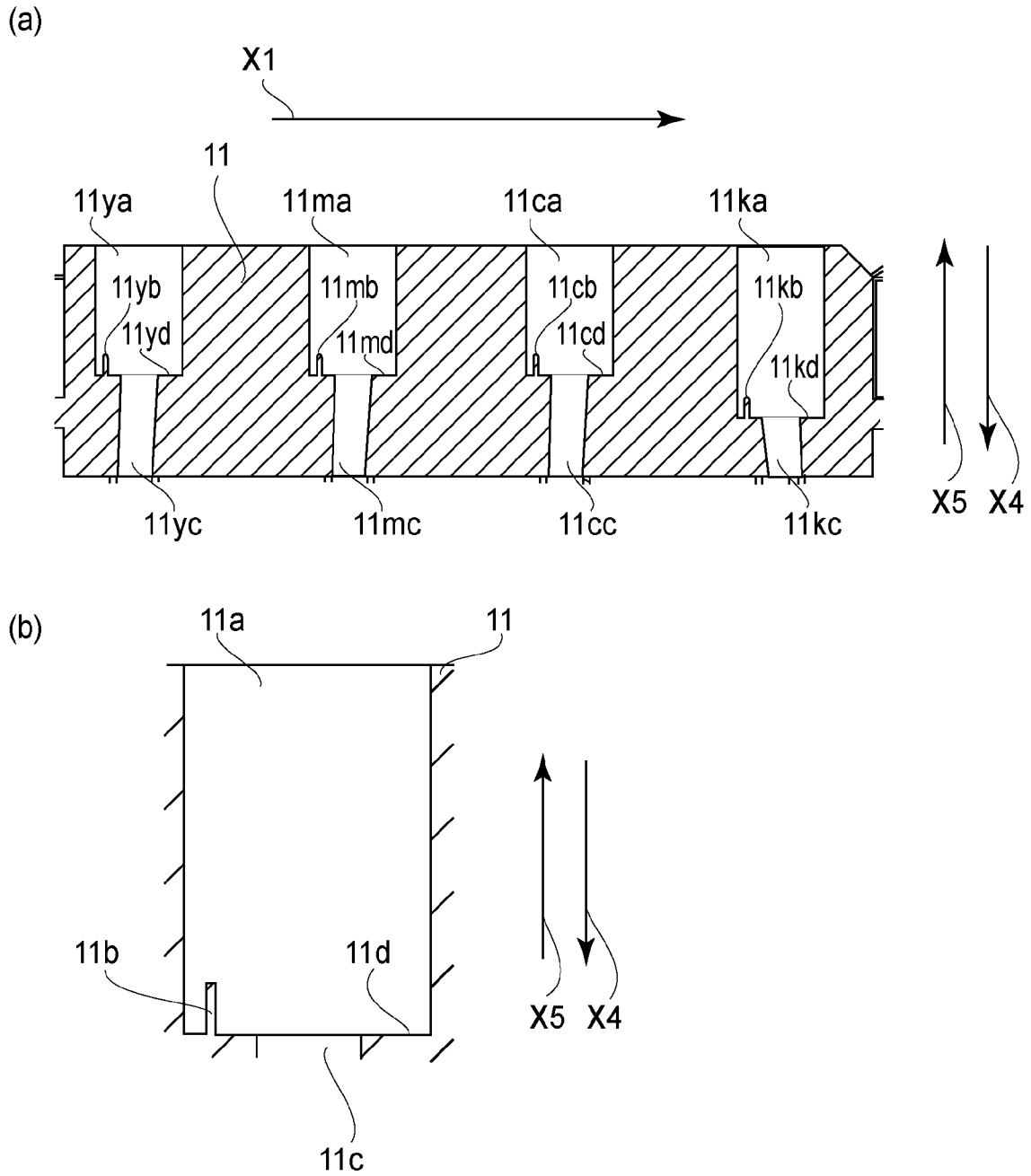
In FIG. 6, (a) is a sectional view, from the right side direction, showing a toner cartridge mounting portion in an unmounted state of the toner cartridge, and (b) is an enlarged sectional view, from the right side direction, showing a mounting location of the toner cartridge in the unmounted state of the toner cartridge.

As shown in FIG. 4B, the image forming apparatus 100 in this embodiment includes a toner cartridge mounting portion 11 to which the toner cartridges 8 are mountable. Further, as shown in FIG. 6, the toner cartridges 8*y*, 8*m*, 8*c*, 8*k* are mounted in the following manner in a state in which a toner cartridge exchange door is opened. That is, the toner cartridges 8 (8*y*, 8*m*, 8*c*, 8*k*) are detachably (removably) mounted at toner cartridge mounting locations 11*a* (11*ya*, 11*ma*, 11*ca*, 11*ka*), respectively, of the mounting portion 11.

Here, the mounting portion 11 is provided on toner moving members 21 (21*y*, 21*m*, 21*c*, 21*k*) capable of expansion and contraction. In this embodiment, the toner moving members 21 for moving the toner downwardly on the drawing sheet of FIG. 4B expansion and contraction by displacement of the mounting portion 11.

The toner moving members 21 (21*y*, 21*m*, 21*c*, 21*k*) connect with developer feeding portions (toner feeding portions) 22 (22*y*, 22*m*, 22*c*, 22*k*), respectively, extending in a vertical direction on the drawing sheet of FIG. 4B. As a result, the toners are moved in the vertical direction on the drawing sheet of FIG. 4B. The toner feeding portions 22 (22*y*, 22*m*, 22*c*, 22*k*) connect with the toner accommodating portions 5 (5*y*, 5*m*, 5*c*, 5*k*), respectively, and feed the toners to the toner accommodating portions 5. As a result, the toners (developers) in the toner cartridges 8 can be supplied to developing portions.

(Structure of Toner Cartridge)

Figure 3:
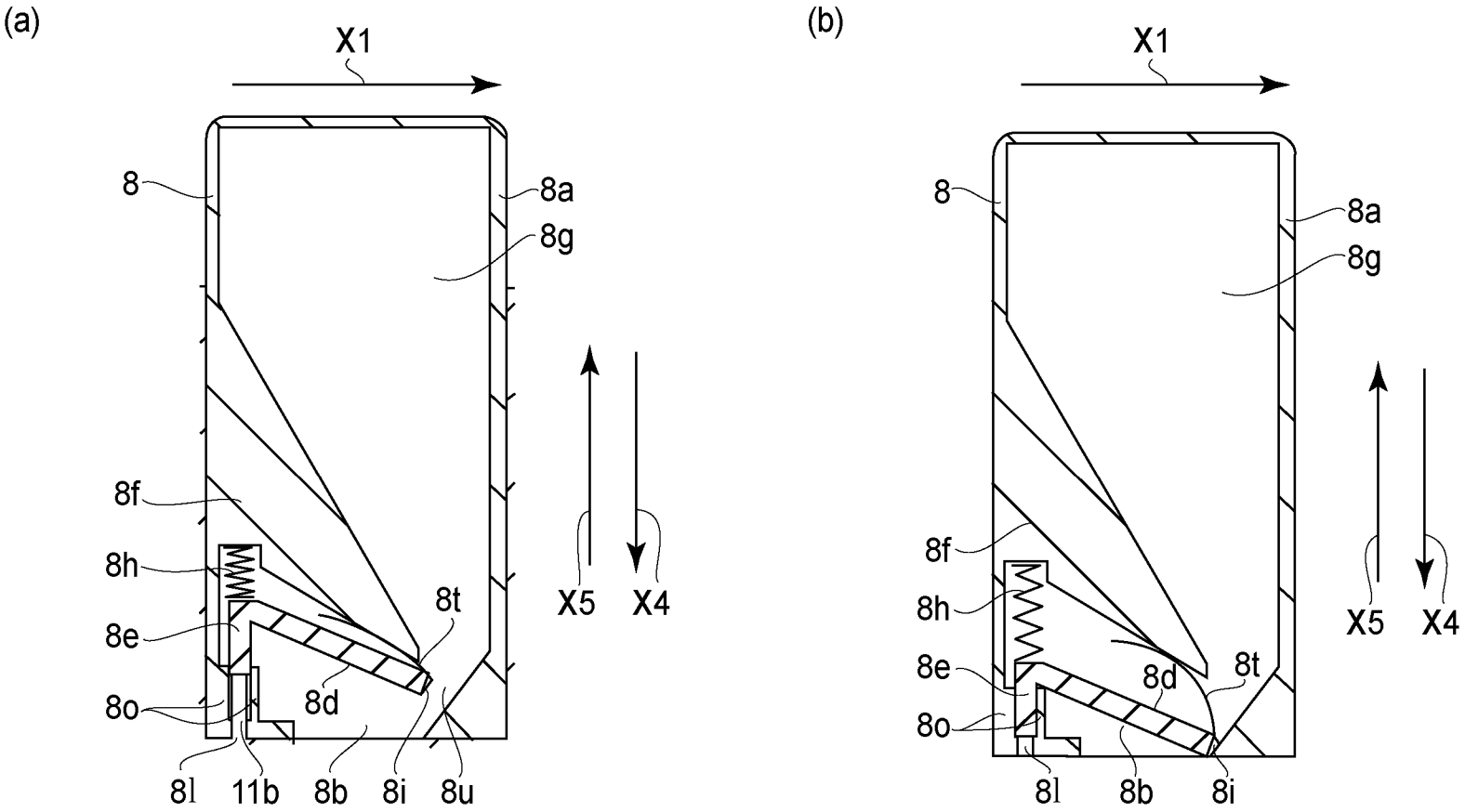
In FIG. 3, (a) is a sectional view, from a right side direction, showing a state in which the toner cartridge is mounted in the toner supplying unit, and (b) is a sectional view, from the right side direction, showing a state in which the toner cartridge is pulled out from the toner supplying unit in a vertical direction.

In FIG. 3, (a) and (b) are sectional views each showing the toner cartridge 8. In FIG. 3, (a) shows a state in which the toner cartridge 8 is mounted in the apparatus main assembly 101, and (b) shows a state in which the toner cartridge 8 is demounted from the apparatus main assembly 101.

The toner cartridge 8 includes a toner cartridge casing 8*a*, an opening 8*b*, a toner cartridge portion-to-be-engaged 8*l*, a shutter 8*d*, and a toner cartridge shutter urging portion 8*e*. The toner cartridge 8 further includes toner cartridge shutter supporting portion 8*f*, a toner accommodating portion 8*g*, an elastic member 8*h*, a toner seal member 8*i*, a shutter guide portion 8*o* and a sheet member 8*t*.

The toner cartridge 8 is capable of being gripped by holding a portion of the casing 8*a*. The portion-to-be-engaged 8*l* is a through hole which is engageable with an engaging portion 11*b* of the mounting portion in the apparatus main assembly described later and which passes through into the casing 8*a*. The shutter 8*d* is guided by the shutter guide portion 8*o* at the urging portion 8*e* which is a part thereof, so that the shutter 8*d* is capable of being displaced in parallel with X4 and X5 directions. At an upper portion of the shutter supporting portion 8*f*, the shutter supporting portion 8*f* has a slope so that the toner slips down along the X4 direction by its own weight.

Further, in order to prevent stagnation of the toner, the sheet member 8*t* is provided on the shutter 8*d*. The sheet member 8*t* is constituted by a material capable of being elastically deformed, and a part thereof contacts a lower surface of the supporting portion 8*f*, and therefore irrespective of movement of the shutter 8*d*, it is possible to prevent the stagnation of the toner on the shutter 8*d*.

As shown in (a) of FIG. 3, in a state in which the toner cartridge 8 is mounted in the apparatus main assembly 101, the shutter urging portion 8*e* is in a state in which the urging portion 8*e* contacts the engaging portion 11*b* of the toner cartridge mounting portion 11 which passed through the portion-to-be-engaged 8*l* and is urged in the X5 direction. Then, the shutter 8*d* is in a state in which the shutter 8*d* is displaced in the X5 direction relative to the casing 8*a*. By this displacement, a gap (spacing) 8*u* generates, so that the toner accommodated in the toner accommodating portion 8*g* is supplied to the mounting portion 11.

Further, as shown in (b) of FIG. 3, in a state in which the toner cartridge 8 is a taken out (demounting) from the apparatus main assembly 101, the shutter 8*d* is in a state in which the shutter 8*d* is urged in the X4 direction by a spring 8*h* connected from the shutter supporting portion 8*f*. In this state, the shutter 8*d* closes the opening 8, and therefore there is no gap 8*u*, so that the toner accommodated in the toner accommodating portion 8*g* is constituted so as not to leak out to an outside of the toner cartridge 8. Here, at a free end of the shutter 8*d*, the seal member 8*i* which is elastically deformable is provided, so that the seal member 8*i* contacts the inside of the casing 8*a* and closes the opening 8*b* while partly deformed, and therefore a high sealing property is obtained.

Figure 2:
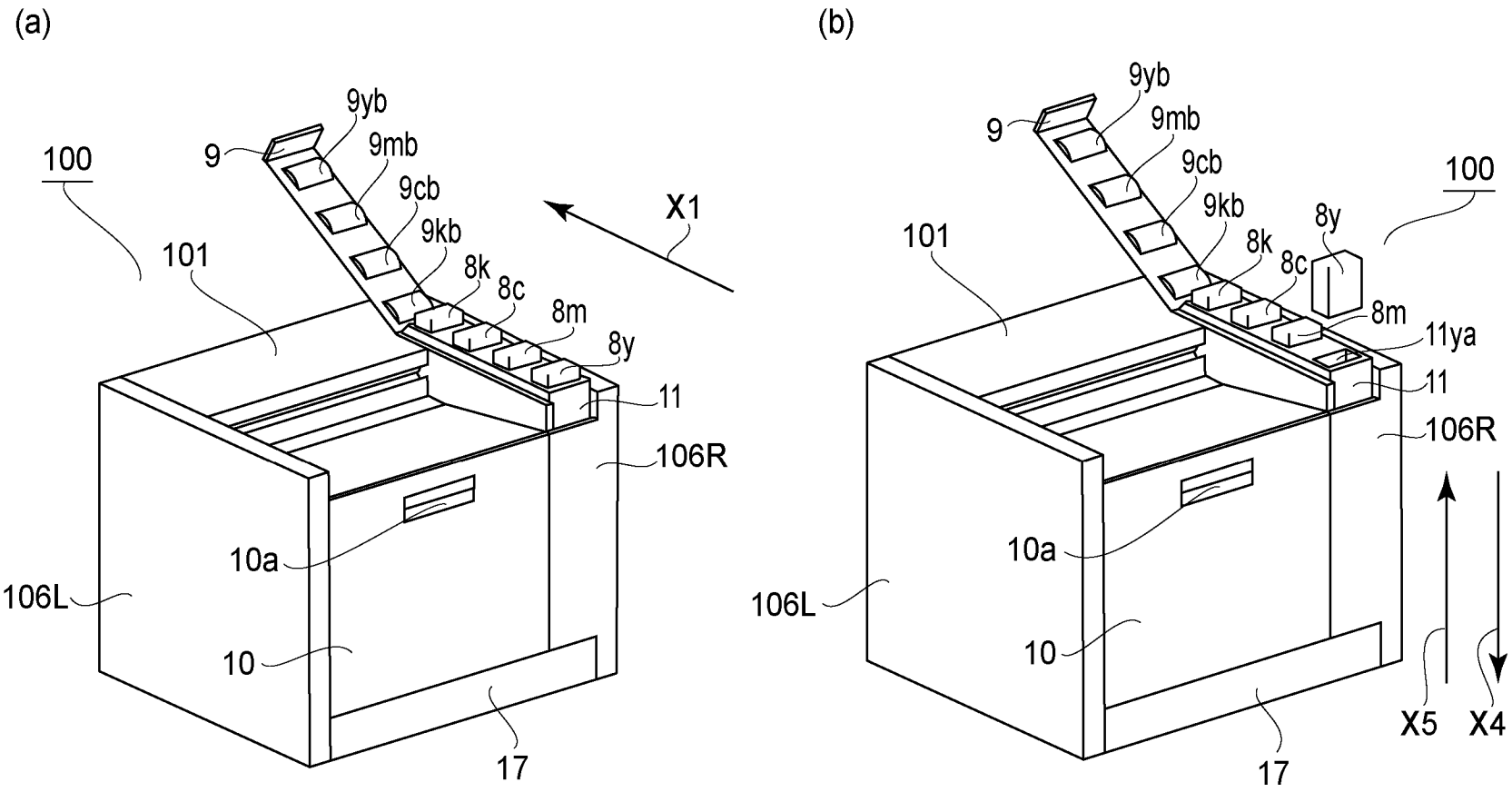
In FIG. 2, (a) is a perspective view of an outer appearance of the image forming apparatus in a state in which a door for toner cartridge exchange of the image forming apparatus, and (b) is a perspective view of an outer appearance of the image forming apparatus before the toner cartridge in the First Embodiment is mounted into a toner supplying unit or after the toner cartridge is demounted from the toner supplying unit.

The toner cartridges 8 (8*y*, 8*m*, 8*c*, 8*k*) are, as shown in FIG. 2, mounted in the listed order from the front side of the apparatus main assembly along X1 direction in a state in which the toner cartridges 8 are mounted into the mounting portion 11. Of these toner cartridges 8, only the toner cartridge 8*k* is larger in volume of the toner accommodating portion 8*kf* compared with the toner cartridges for other colors, and also a size thereof is large correspondingly.

(Structure of Toner Supplying Unit in Apparatus Main Assembly)

As shown in FIG. 4B, the toner supplying unit 104 includes the mounting portion 11, the toner moving members 21 (21*y*, 21*m*, 21*c*, 21*k*) and the toner feeding portions 22 (22*y*, 22*m*, 22*c*, 22*k*).

Figure 5A:
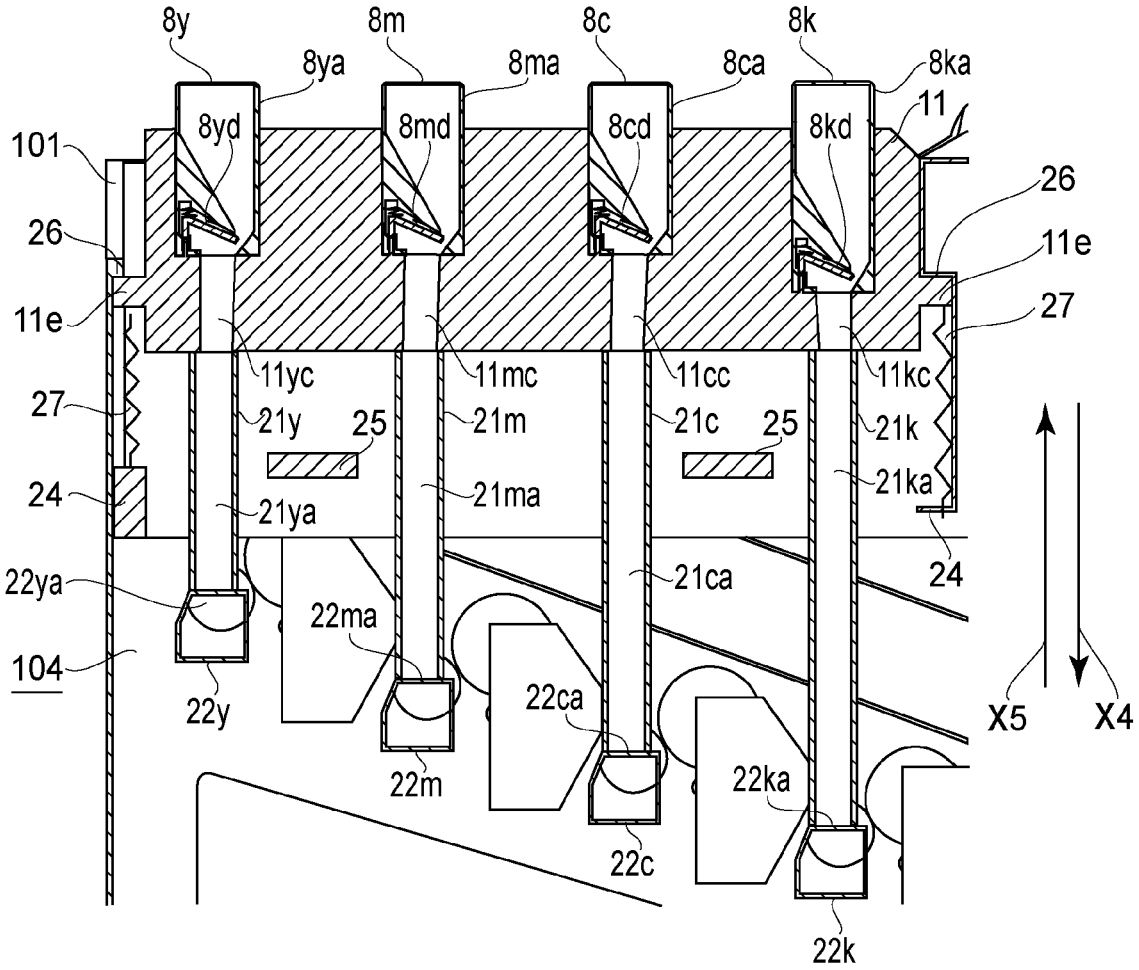
FIG. 5A is a sectional view, from the right side direction, showing the toner supplying unit in a state in which the door is opened.
Figure 5B:
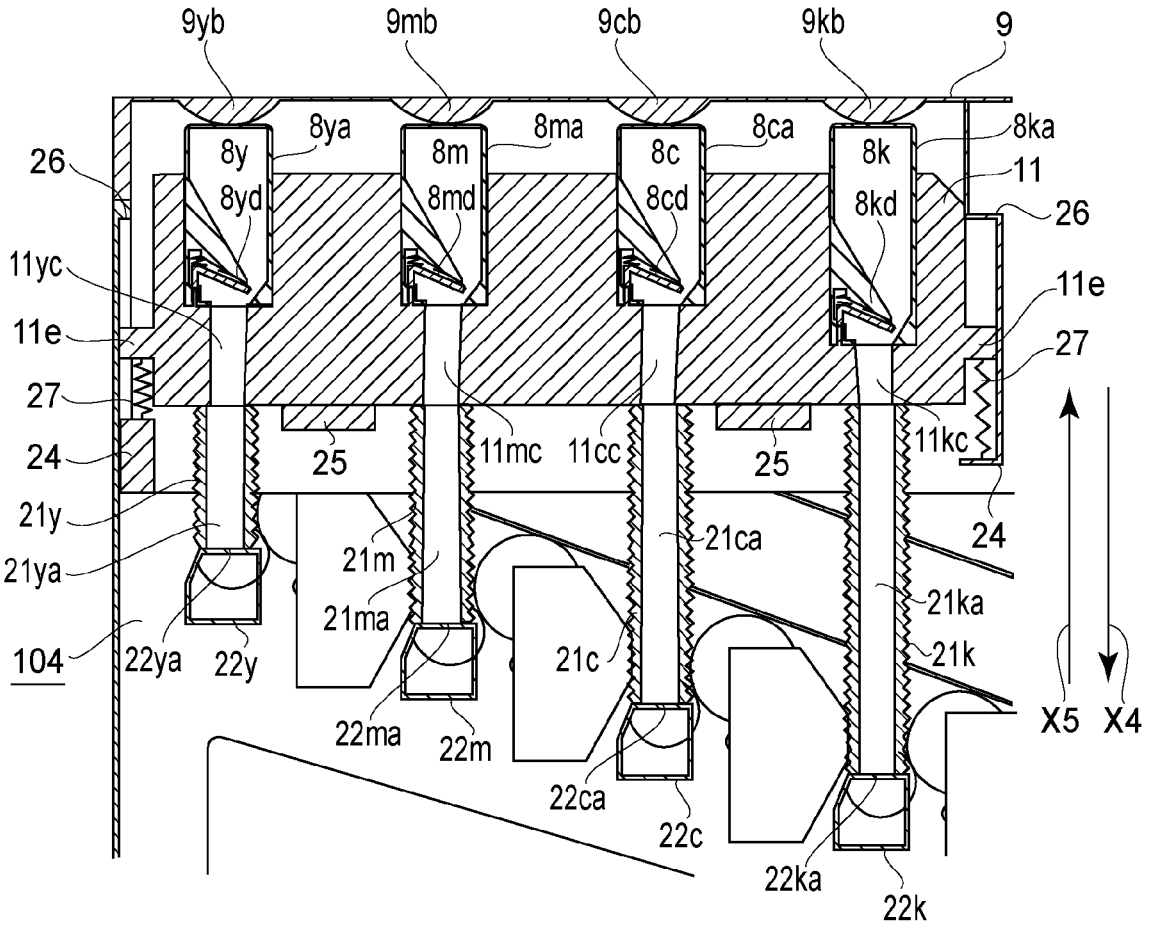
FIG. 5B is a sectional view, from the right side direction, showing the toner supplying unit in a state in which the door is closed.

FIG. 5A is a sectional view of the toner supplying unit 104 when the door 9 is opened (in an open state of the mounting portion 11), and FIG. 5B is a sectional view of the toner supplying unit 104 when the door 9 is closed (in a closed state of the mounting portion 11). In FIG. 6, (a) is a sectional view, from a right side direction, of the toner cartridge mounting portion 11 in a state in which the toner cartridges 8 (8*y*, 8*m*, 8*c*, 8*k*) are demounted, and (b) is an enlarged view of the mounting location 11*a* of the toner cartridge mounting portion 11.

1) Mounting Portion

As shown in (a) of FIG. 6, at the mounting portion 11, 4 mounting locations 11*a* (11*ya*, 11*ma*, 11*ca*, 11*ka*) are provided in the listed order along the X1 direction so that the toner cartridges 8 (8*y*, 8*m*, 8*c*, 8*k*) are mountable.

At bottoms 11*d* (11*yd*, 11*md*, 11*cd*, 11*kd*) of the mounting portion 11*a*, the toner cartridge engaging portions 11*b* (11*yb*, 11*mb*, 11*cb*, 11*kb*) are provided, respectively. Further, toner discharge openings 11*c* (11*yc*, 11*mc*, 11*cc*, 11*kc*) are provided. As shown in FIG. 3, when the toner cartridges 8 are mounted into the mounting locations 11*a* along the X4 direction, the engaging portions 11*b* engage with the portion-to-be-engaged 8*l* (81*yl*, 81*ml*, 81*cl*, 81*kl*).

Then, when the toner cartridges 8 are further mounted into the mounting locations 11*a*, the engaging portions 11*b* penetrate through the portion-to-be-engaged 8*l* and are contactable to the shutters 8 (8*yd*, 8*md*, 8*cd*, 8*kd*). Further, a size of each of the engaging portions 11*b* with respect to the X5 direction is not particularly limited, but may only be required to be as shown in (a) of FIG. 3. That is, in a state in which the engaging portion 11*b* and the portion-to-be-engaged 8*l* of the toner cartridge 8 are sufficiently engaged with each other, the size of the engaging portion 11*b* may only be required to be a length in which the engaging portion 11*b* is capable of pushing up the shutter 8*d* in the X5 direction to the extent that the gap 8*u* capable of permitting movement of the toner from the toner accommodating portion 8*g* toward the opening 8*b* generates.

Incidentally, in (a) of FIG. 3, engagement between the engaging portion 11*b* and the portion-to-be-engaged 8*l* is made by a snap-fit mechanism (constitution in which a projected portion of one of the portions is engaged in and hooked in a recessed portion of the other portion by using elasticity of materials). That is, the toner cartridge 8 can be sufficiently mounted into the mounting location 11*a* by applying a certain force or more in the X4 direction.

Further, in FIG. 6, each of the toner discharge openings 11*c* has a constitution provided with a slope with respect to the X4 direction, so that the toner easily drops through the toner discharge opening 11*c*. Further, in FIG. 5A, on each of the right side and the left side of the mounting portion 11, an end portion 11*e* is provided. Under the end portion 11*e*, an elastic member 27 as an expansion and contraction member is provided, and an opposite end portion of the elastic member 27 is connected with a supporting portion 24 for the mounting portion. For that reason, the mounting portion 11 is always in a state in which the mounting portion 11 is urged from the supporting portion 24 in the X5 direction through the elastic member 27.

Further, the end portion 11*e* also functions as a portion-to-be-guided relative to the apparatus main assembly 101. For that reason, the mounting portion 11 is capable of being displaced in a direction parallel to the X4 and X5 directions. The apparatus main assembly 101 is provided with displacement limiting portions 25, 26 for limiting the displacement of the mounting portion 11. The mounting portion 11 is capable of being displaced in the X4 direction to a contact position with the displacement limiting portion 25 and is capable of being displaced in the X5 direction to a contact position with the displacement limiting portion 26.

2) Toner Moving Member 21

As shown in FIG. 4B, the toner moving members 21 (21*y*, 21*m*, 21*c*, 21*k*) are provided between the mounting portion 11 and the toner feeding portions 22 (22*y*, 22*m*, 22*c*, 22*k*). Upper surfaces of the toner moving members 21 are in a contact state with a lower surface of the mounting portion 11, and lower surfaces of the toner moving members 21 are in a contact state with upper surfaces of the toner feeding portions 22.

The toner moving member 21 is, as shown in FIGS. 5A and 5B, constituted by a bellow material capable of expansion and contraction in a certain amount, and thus has a bellow shape, so that the toner moving member 21 has a constitution in which the mounting portion 11 contracts in accordance with movement thereof in the X4 direction and expands in accordance with movement thereof in the X5 direction.

Further, the toner moving members 21 are provided with toner drop openings 21*a* (21*ya*, 21*ma*, 21*ca*, 21*ka*) at insides thereof, so that the toner can be dropped in the X4 through each of the toner drop openings 21*a*.

Further, the toner moving members 21 are disposed so that the toner discharge openings 11*c* of the mounting portion 11, the toner drop openings 21*a* and toner receiving openings 22*a* (22*ya*, 22*ma*, 22*ca*, 22*ka*) of the toner feeding portions 22 overlap with each other with respect to the X4 direction. For this reason, the toner can be dropped from the mounting portions 11 to the toner feeding portions 22.

Incidentally, lengths of the toner moving members 21 with respect to the X4 direction are made different depending on associated colors of the toners.

3) Toner Feeding Portion 22

As shown in FIGS. 5A and 5B, each of the toner moving members 21 is provided with the toner receiving opening 22*a* at an upper portion thereof, so that the toner is fed into the toner feeding portion 22 through the toner receiving opening 22*a*. Further, the toner feeding portion 22 is connected with the toner accommodating portion 5, and the toner is fed to the toner accommodating portion 5 by an inside screw (not shown).

(Structure of Door for Apparatus Main Assembly)

At an upper surface of the door 9 in a position shown in FIG. 1, a handle 9*a* is provided, and a user holds the handle 9*a* to open and close the door 9, so that the door 9 rotates about a hinge shaft (not shown). FIG. 1 shows a closed state of the door 9, and FIG. 2 shows an open state of the door 9.

As shown in FIG. 2, at a lower surface of the door 9, toner cartridge urging portions 9*b* (9*yb*, 9*mb*, 9*cb*, 9*kb*) are provided. Each of the urging portions 9*b* has an arcuate shape as seen from a side surface, but may also have another shape if the urging portion 9*b* is capable of smoothly contacting the toner cartridge 8. The urging portion 9*b* may also be constituted by an elastically deformable material so as not to break the toner cartridge 8 when the door 9 is closed and the urging portion 9*b* contacts the toner cartridge 8.

(During Mounting of Toner Cartridge)

In FIG. 2, (b) shows a state before the toner cartridge 8*y* is mounted into the apparatus main assembly 101. In a state in which the door 9 is sufficiently opened, the toner cartridge 8*y* can be mounted into the mounting location 11*ya* of the mounting portion 11 in parallel to the X4 direction. In the following, using FIG. 3 and (b) of FIG. 6, mounting of the toner cartridge 8 will be described. Incidentally, in this embodiment, a mounting method of the toner cartridge 8*y* is shown, but other toner cartridges 8*m*, 8*c*, 8*k* can also be similarly mounted.

When the toner cartridge 8 is mounted into the mounting location 11*a* along the X4 direction, in a state in which the toner cartridge 8 is mounted in a certain amount or more, the engaging portion 11*b* of the mounting portion 11 and the portion-to-be-engaged 8*l* of the toner cartridge 8 start to contact and engage with each other. After the engagement, when the toner cartridge 8 is further pushed into the mounting location 11*a* in the X4 direction, the portion-to-be-engaged 8*l* reaches an inside of the casing 8*a*. At this time, the engaging portion 11*b* which reached the inside of the casing 8*a* and the lower surface of the shutter urging portion 8*e* are in contact with each other. When the engaging portion 11*b* is further inserted into the inside of the casing 8*a*, the shutter urging portion 8*e* is correspondingly pushed up in the X5 direction.

Then, when the toner cartridge 8*y* is sufficiently mounted to the mounting location 11*a*, as shown in (a) of FIG. 3, the shutter 8*d* is sufficiently pushed up in the X5 direction and the gap 8*u* generates between the shutter 8*d* and the casing 8*a*, with the result that the toner is discharged to the outside of the toner cartridge 8*y* through the opening 8*b*. As a result, the toner is supplied from the toner cartridge 8 to an inside of the toner supplying unit 104 of the apparatus main assembly 101. A sectional view of the apparatus main assembly 101 in a state in which this operation is performed for the toner cartridges 8 for all of the colors and in which the toner cartridges 8 are sufficiently mounted to the mounting portion 11 and then the door 9 opens is shown in FIG. 5A.

Here, in a state in which the mounting of all of the toner cartridges 8 to the mounting portion 11 is completed (FIG. 5A), the door 9 is gradually closed while gripping the handle 9*a* of the door 9. When the door 9 is closed to some extent, the urging portions 9*b* of the door 9 and the upper portions of the toner cartridges 8 in the mounted state to the mounting locations 11 contact each other. Further, when the door 9 is further closed, the urging portions 9*b* urge the toner cartridges 8 in the X4 direction. Irrespective of sufficient mounting and insufficient mounting of the toner cartridges 8 to the mounting portion 11, as the toner cartridges 8 are urged, also the mounting portion 11 is urged in the X4 direction, so that both of the toner cartridges 8 and the mounting portion 11 are gradually displaced in the X4 direction.

Then, in association with the door 9, when the mounting portion 11 is displaced in the X4 direction to a predetermined position, the lower surface of the mounting portion 11 contacts the displacement limiting portions 25. By this contact, the displacement of the mounting portion 11 in the X4 direction stops. In this state in which the toner cartridges 8 are sufficiently mounted to the mounting portion 11, as shown in FIG. 5B, the door 9 is closed in a state in which the urging portions 9*b* and the upper surfaces of the toner cartridges 8 are in contact with each other and in which the mounting portion 11 and the displacement limiting portions 25 are in contact with each other. At this time, the apparatus main assembly 101 is in an image formable state.

Further, in a state in which the toner cartridges 8 are not sufficiently mounted to the mounting portion 11, the door 9 is rotated in a closing direction from a state in which the toner cartridges 8 contact the urging portions 9*b* of the door 9 and in which the mounting portion 11 contacts the displacement limiting portions 26. As a result, the urging portions 9*b* gradually push the toner cartridges 8 in the X4 direction, and the door 9 is sufficiently closed, so that as shown in FIG. 5B, the toner cartridges 8 are in a state in which the toner cartridges 8 are sufficiently mounted to the mounting portion 11. Incidentally, when the door 9 is closed, the door 9 receives an urging force in the X5 direction from the elastic members 27 through the mounting portion 11, and therefore there is a need to apply a certain force or more.

(During Demounting of Toner Cartridge)

Next, a state in which the toner cartridge 8*y* is demounted from the apparatus main assembly 101 will be described. In this step, the above-described mounting process of the toner cartridge 8*y* into the apparatus main assembly 101 is reversely performed. In this embodiment, a demounting method of the toner cartridge 8*y* is shown, but other toner cartridges 8*m*, 8*c*, 8*k* can also be similarly demounted.

Before the toner cartridges 8 are exchanged, as shown in FIG. 5B, the apparatus main assembly 101 is in an image formable state. In this state, the mounting portion 11 receives a force for urging the mounting portion 11 in the X5 direction from the elastic members 27 through the end portions 11*e*. However, a force, for urging the mounting portion 11 in the X4 direction, received by the mounting portion 11 from the urging portions 9*b* of the door 9 through the cartridges 8 is large, and therefore the mounting portion 11 is in a state in which the mounting portion 11 does not move.

From this state, when the handle 9*a* is held and the door 9 is opened gradually, the urging force exerted from the elastic member 27 on the mounting portion 11 in the X5 direction is unchanged, but the influence of the urging portions 9*b* gradually decreases. For that reason, with an opening operation of the door 9, the mounting portion 11 is displaced correspondingly to a certain distance in the X5 direction in a state in which either of the toner cartridges 8 contacts the associated urging portion(s) 9*b*. After the door 9 is opened to some extent or more, when the contact between the toner cartridges 8 and the urging portions 9*b* is eliminated, the mounting portion 11 is further displaced in the X5 direction in a certain amount.

After the mounting portion 11 is displaced in the X5 direction in the certain amount, the upper surfaces of the end portions 11*e* of the mounting portion 11 contact the displacement limiting portions 26. By this contact, the development of the mounting portion 11 in the X5 direction stops, so that the mounting portion 11 is in a state shown in FIG. 5A. Incidentally, when the door 9 is changed from the closed state to the open state quickly, also the mounting portion 11 quickly moves from a position of FIG. 5B to a position of FIG. 5A. Also at this time, the engaging portions 11*b* of the mounting portion 11 and the portions-to-be-engaged 8*l* of the toner cartridges 8 are in an engaged state, and therefore the toner cartridges 8 are not demounted from the mounting portion 11 and also the toner is not leaked out to the outside of the toner cartridges 8. This state in which the door 9 is sufficiently opened is shown in (b) of FIG. 2.

Thus, in the state in which the door 9 is opened, the toner cartridge 8*y* is gradually demounted in parallel to the X5 direction. At this time, as shown in FIG. 5A, the mounting portion 11 and the toner cartridges 8 are in a state (projected state) in which these portions (members) project from an outer configuration of the apparatus main assembly 101 to the outside of the toner cartridges 8. For this reason, the user can demount the toner cartridges 8 without reaching into the apparatus main assembly 101 with his (or her) hand.

A state before the toner cartridges 8 are demounted from the mounting portion 11 is, as shown in (a) of FIG. 3 and FIG. 5A, in such a state that the engaging portions 11*b* penetrate through the portions-to-be-engaged 8*l* of the toner cartridges 8 and push up the shutters 8*d* in the X5 direction. From this state, when the toner cartridges 8 are pulled out in the X5 direction, the shutter urging portions 8*e* are gradually moved away from the engaging portions 11*b*, and therefore an amount of contraction of the springs 8*h* connecting the shutters 8*d* and the toner cartridge supporting portions 8*f* becomes small.

As a result, the springs 8*h* expand in the X4 direction, and also the shutters 8*d* are displaced in the X4 direction, so that the gaps 8*u* gradually narrow (close). Then, when the toner cartridges 8 are gradually demounted along the X5 direction, contact between the engaging portions 11*b* and the shutter urging portions 8*e* is eliminated and the shutters 8*d* return to predetermined positions, so that a state in which the gaps 8*u* are eliminated is formed and a state in which the openings 8*b* are sufficiently closed is formed. As a result, when the toner cartridges 8 are taken out to the outside of the apparatus main assembly 101, it is possible to prevent the toners inside the casings 8*a* from leaking out to the outside of the casings 8*a*.

Thereafter, when the toner cartridges 8 are further be mounted in the X5 direction, also engagement between the engaging portions 11*b* and the portions-to-be-engaged 8*l* is eliminated (disengaged), so that the toner cartridges 8 are in the state shown in FIG. 5B. Then, finally, as shown in FIG. 6, the toner cartridges 8 can be sufficiently demounted from the mounting locations 11*a*.

<Second Embodiment>

Similarly as in the First Embodiment, also in this embodiment, the door 9 is provided. Different from the First Embodiment, in this embodiment, a constitution in which in interrelation with the opening and closing of the door 9, where only the grip portions of the toner cartridges are displaced but the mounting portion (toner cartridge mounting portion) is not displaced (i.e., is kept at the predetermined position), is employed.

(Structure of Toner Cartridge)

Figure 10:
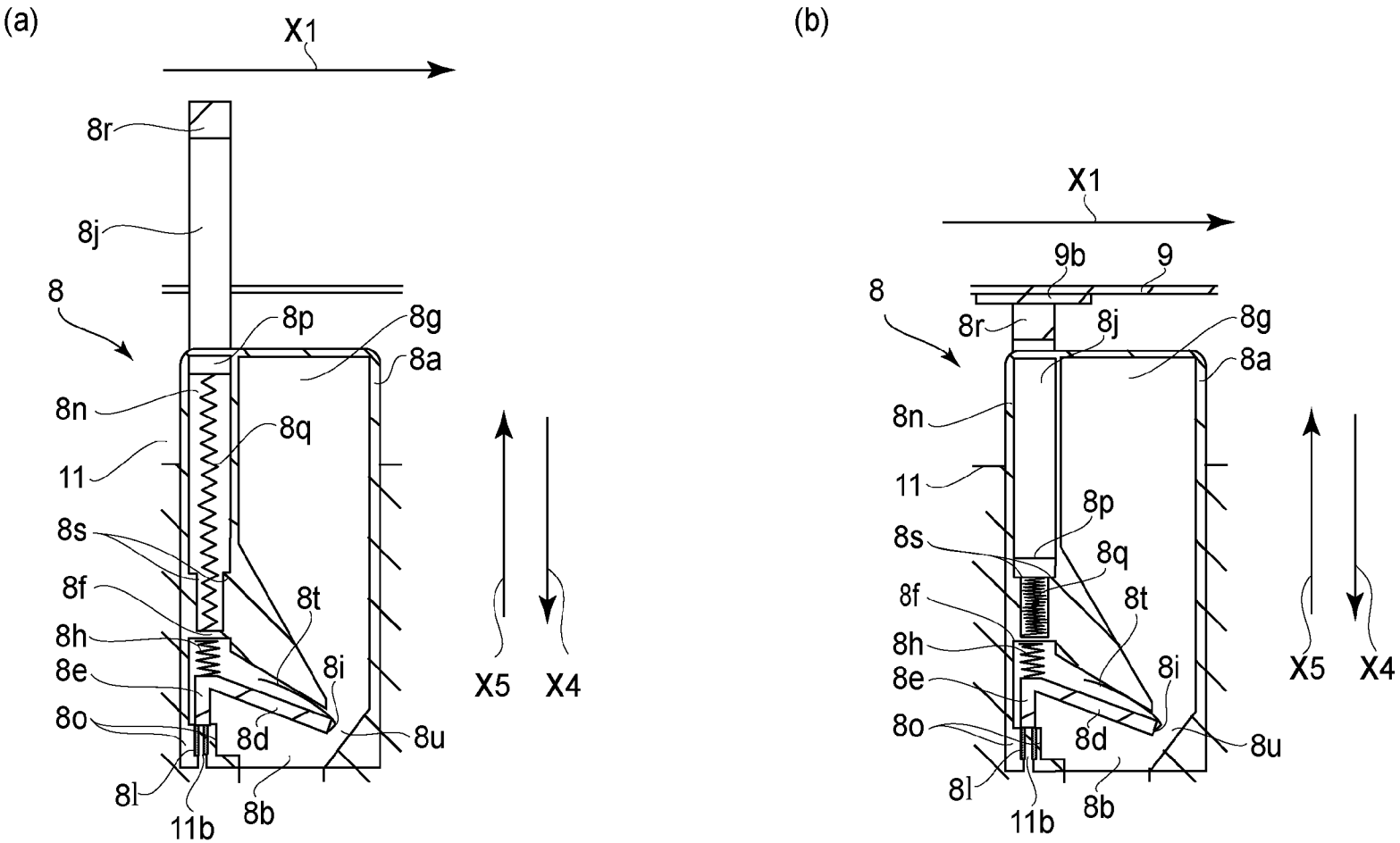
In FIG. 10, (a) is a sectional view, from the right side direction, showing a toner cartridge in a state in which the toner cartridge is mounted in a toner supplying unit and then the door is opened, and (b) is a sectional view, from the right side direction, showing the toner cartridge in a state in which the toner cartridge mounted in the toner supplying unit and then the door is closed.
Figure 11:
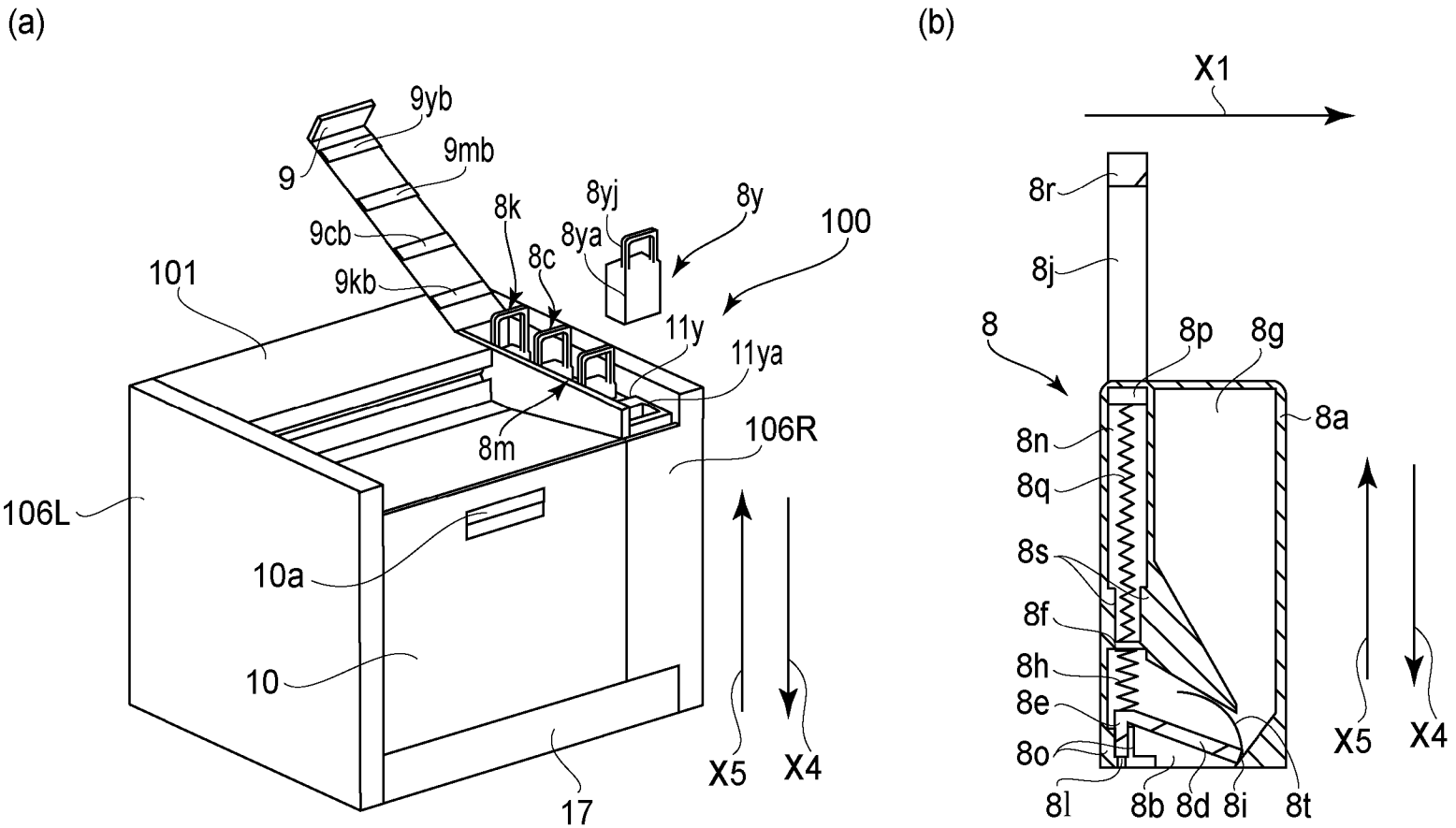
In FIG. 11, (a) is perspective view of an outer appearance of the image forming apparatus before the toner cartridge is mounted into the toner supplying unit or after the toner cartridge is demounted from the toner supplying unit, and (b) is a sectional view, from the right side direction, showing the toner cartridge in a state in which the toner cartridge is mounted from the toner supplying unit.

Each of (a) and (b) of FIG. 10 and (b) of FIG. 11 is a sectional view of a toner cartridge 8 in this embodiment. In FIG. 10, (a) is the sectional view showing a state in which the toner cartridge 8 is mounted in the apparatus main assembly 101 and the door 9 is open, and (b) is the sectional view showing a state in which the toner cartridge 8 is mounted in the apparatus main assembly 101 and the door 9 is closed. Further, (b) of FIG. 11 is the sectional view showing a state in which the toner cartridge 8 is demounted from the apparatus main assembly 101.

The toner cartridge 8 includes a casing 8*a*, an opening 8*b*, a portion-to-be-engaged 8*l*, a shutter 8*d*, a toner cartridge shutter urging portion 8*e*, shutter supporting portion 8*f*, a toner accommodating portion 8*g*, elastic members 8*h*, 8*q* as expansion and contraction members and a toner seal member 8. The toner cartridge 8 further includes a toner cartridge grip portion 8*j*, a grip portion accommodating portion 8*n*, a shutter guide portion 8*o*, a sheet member 8*t* and a grip portion contact portion 8*s*.

The portion-to-be-engaged 8*l* is a through hole which is engageable with an engaging portion 11*b* and which passes through into the casing 8*a*. Further, at an upper portion of the shutter supporting portion 8*f*, a sufficient slope relative to the X4 direction is provided so that the toner can slip down.

With respect to the toner cartridge 8, the user is capable of performing a demounting operation while gripping the grip portion 8*j*. The grip portion 8*j* is provided with an upper grip portion 8*r* and a lower grip portion 8*p*, and the elastic member 8*q* contacts a lower surface of the lower grip portion 8*p*. The elastic member 8*q* is an urging spring and is provided above the shutter supporting portion 8*f*. For that reason, in a state in which an external force exerted on the grip portion 8*j* in the X4 direction does not generate, as shown in (a) of FIG. 10, the grip portion 8*j* is disposed at a second position where the grip portion 8*j* is pushed up in the X5 direction. At this time, by contact of the lower grip portion 8*p* with the casing 8*a*, the grip portion 8*j* is limited so that the grip portion 8*j* cannot move further in the X5 direction.

Further, in a state in which the external force exerted on the grip portion 8*j* in the X4 direction generates, as shown in (b) of FIG. 10, the grip portion 8*j* is urged in the X4 direction, so that the grip portion 8*j* is disposed at a first position where the grip portion 8*j* is accommodated in the grip portion accommodating portion 8*n* and the image is formable. At this time, the elastic member 8*q* is in a contracted state by the external force. Further, by contact of the lower grip portion 8*p* with the grip portion contact portion 8*s*, that the grip portion 8*j* is limited so that the grip portion 8*j* cannot move further in the X4 direction. When this grip portion 8*j* moves in the grip portion accommodating portion 8*n*, a part of the toner cartridge casing 8*a* constitutes a guide, so that the grip portion 8*j* can move in parallel with the X4 direction or the X5 direction.

The shutter 8*d* is guided by the shutter guide portion 8*o* at the shutter urging portion 8*e* which is a part thereof, so that the shutter 8*d* is capable of being moved in parallel with X4 and X5 directions. When the shutter 8*d* moves, in order to prevent stagnation of the toner, the sheet member 8*t* is provided on the shutter 8*d*. The sheet member 8*t* is constituted by a material capable of being elastically deformed, and a part thereof always contacts a lower surface of the supporting portion 8*f*. For that reason, irrespective of movement of the shutter 8*d*, it is possible to prevent the stagnation of the toner on the shutter 8*d*.

As shown in (b) of FIG. 3, in a state in which the toner cartridge 8 is a taken out (demounting) from the apparatus main assembly 101, the shutter 8*d* is in a state in which the shutter 8*d* is urged in the X4 direction by a spring 8*h* connected from the shutter supporting portion 8*f*. In this state, the shutter 8*d* closes the toner cartridge opening 8, and therefore there is no gap 8*u* between the shutter 8*d* and the casing 8*a*, so that the toner accommodated in the toner accommodating portion 8*g* is constituted so as not to leak out to an outside of the toner cartridge 8. Here, at a free end of the shutter 8*d*, the seal member 8*i* which is elastically deformable is provided, so that the seal member 8*i* contacts the casing 8*a* and closes the toner cartridge opening 8*b* while partly deforms, and therefore a high sealing property is obtained.

Further, as shown in (a) and (b) of FIG. 10, in a state in which the toner cartridge 8 is sufficiently mounted into the apparatus main assembly 101, the shutter urging portion 8*e* contacts the engaging portion 11*b*, of the mounting portion 11, penetrating through the portion-to-be-engaged 8*l* and thus is in an urged state in the X5 direction. Then, the shutter 8*d* is in a state in which the shutter 8*d* moves in the X5 direction relative to the toner cartridge casing 8*a*. By this movement, the gap 8*u* generates between the shutter 8*d* and the casing 8*a*, so that the toner accommodated in the accommodating portion 8*g* is supplied to the mounting portion 11.

Figure 9A:
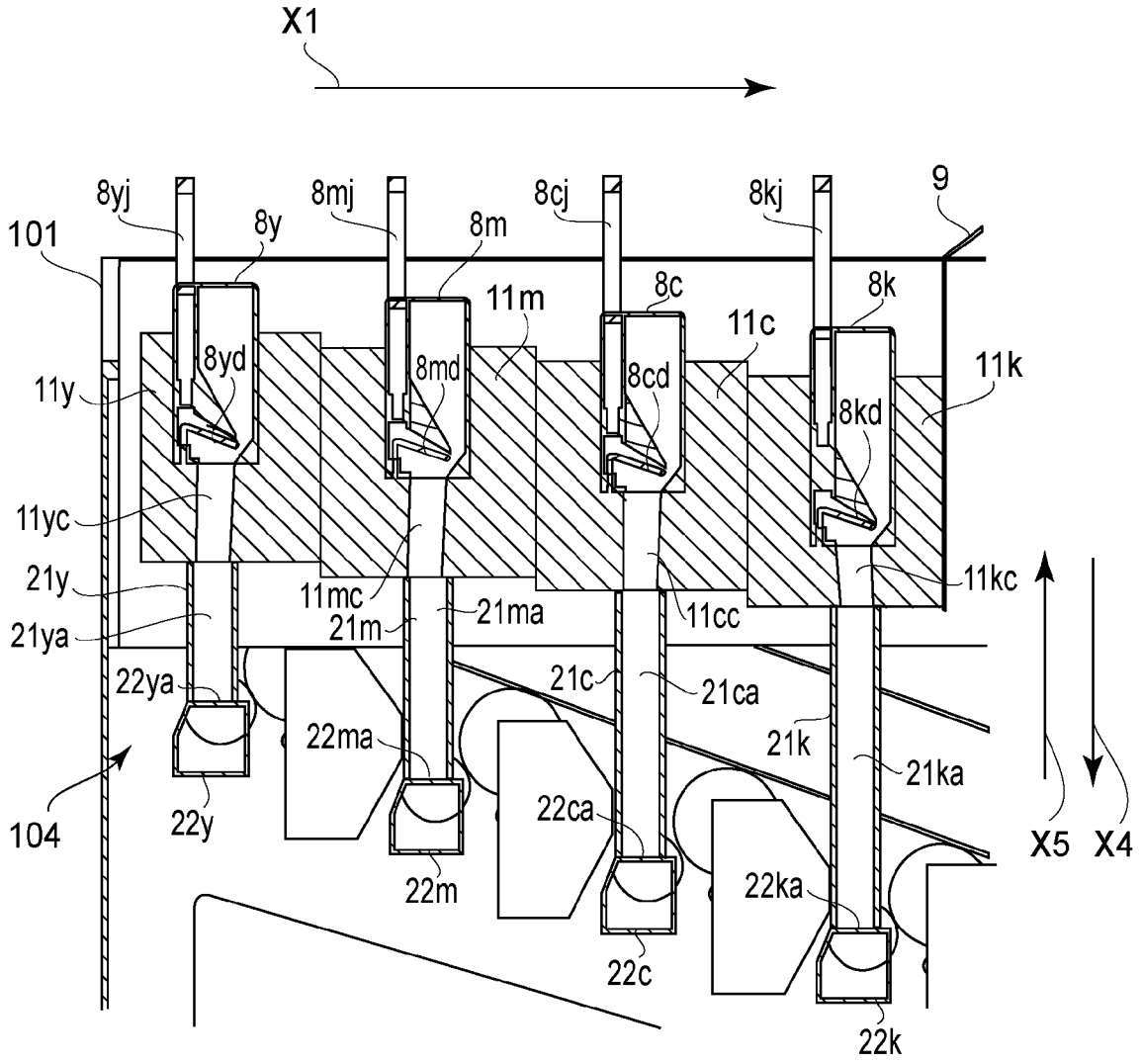
FIG. 9A is a sectional view, from the right side direction, showing the toner supplying unit in a state in which the door is opened.

Here, as shown in FIG. 9A, the grip portions 8*j* (8*yj*, 8*mj*, 8*cj*, 8*kj*) are different in length with respect to the X5 direction for each color. This is because lengths of the grip portions 8*j* are different with respect to the X5 direction when the toner cartridges 8 are mounted into the mounting portions 11 but when the door 9 is opened and the grip portions 8*j* are moved from the first position to the second position, the grip portions 8*j* are placed in a substantially aligned state (in which end positions of the grip portions 8*j* are aligned with a predetermined (horizontal) surface).

Incidentally, this aligned state is not required to be substantially the same level (height) with respect to the X5 direction, but may only be required that a difference in height of the grip portions 8*j* with respect to the X5 direction is smaller than a difference in height of the toner cartridges 8 with respect to the X5 direction when the toner cartridges 8 are mounted into the mounting portions 11.

Further, by the difference in length of the grip portions 8*j* with respect to the X5 direction, even when the user inserts the toner cartridge 8 into an erroneous mounting portion 11, the door 9 cannot be closed, and therefore erroneous mounting of the toner cartridge 8 can be prevented.

Figure 8:
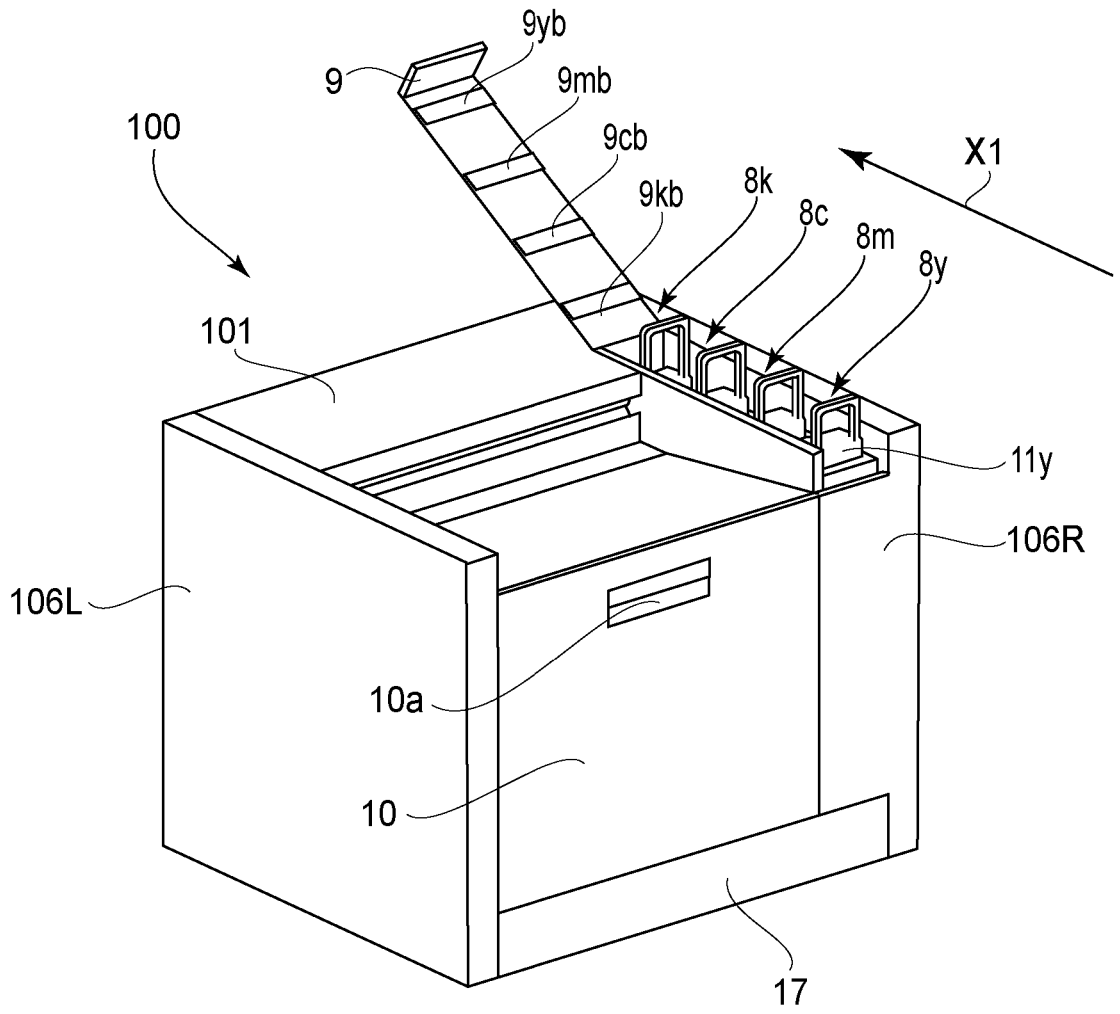
FIG. 8 is a perspective view of an outer appearance of the image forming apparatus in a state in which a door for toner cartridge exchange in the Second Embodiment is opened.
Figure 9B:
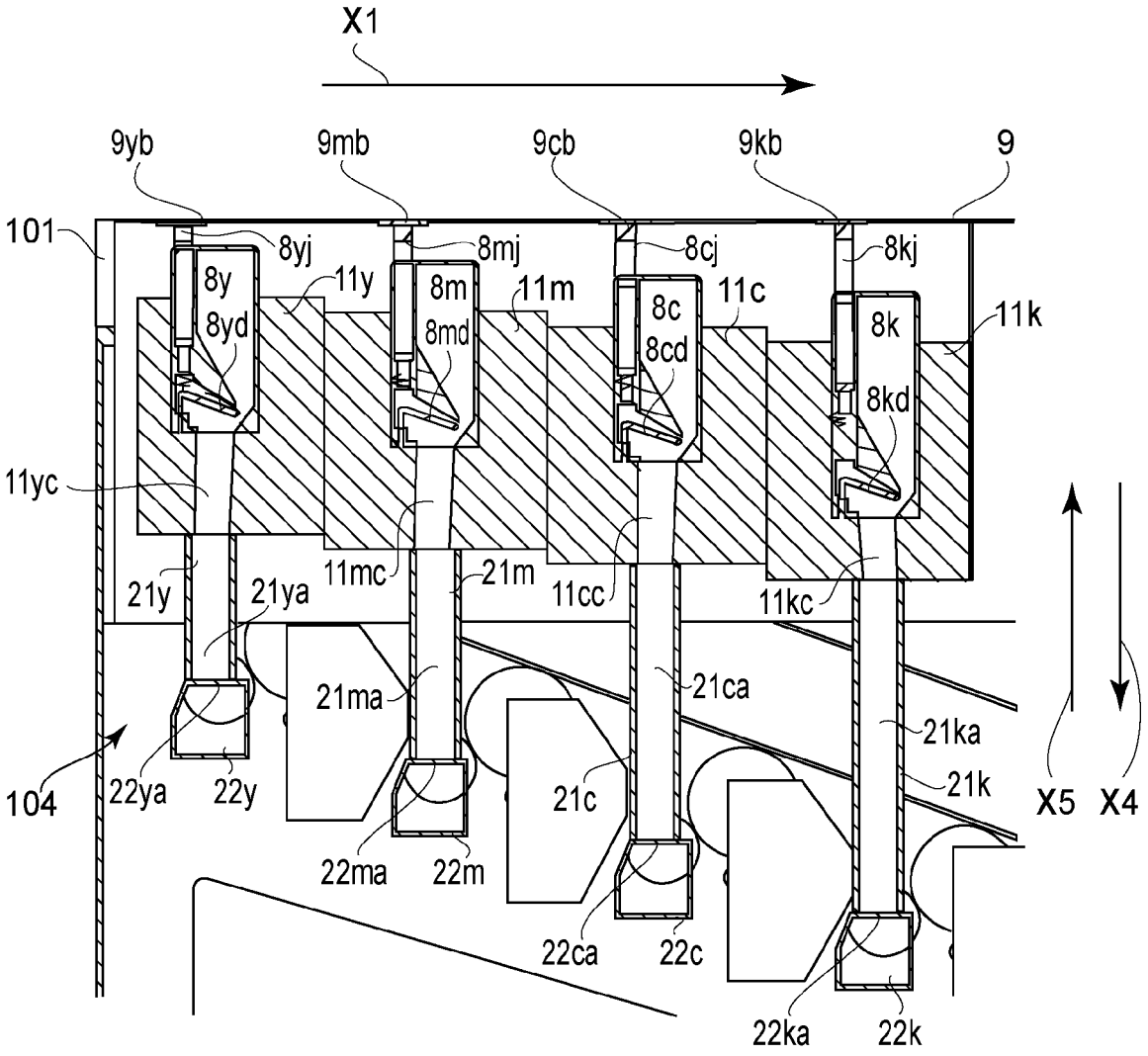
FIG. 9B is a sectional view, from the right side direction, showing the toner supplying unit in a state in which the door is closed.

Incidentally, as shown in FIG. 8, the toner cartridges 8 are mounted in the order of 8*y*, 8*m*, 8*c*, 8*k* from the front side of the apparatus main assembly along X1 direction in a state in which the toner cartridges 8 are mounted into the mounting portion 11. Of these toner cartridges 8, only the toner cartridge 8*k* is larger in volume of the toner accommodating portion 8*kf* compared with the toner cartridges for other colors, and therefore a shape thereof is large as shown in FIGS. 9A and 9B.

However, the toner cartridge increased in volume and size is not limited to the toner cartridge 8*k*, but may also be another toner cartridge or other toner cartridges for a plurality of colors. Further, the order of arrangement of the toner cartridges 8 into the apparatus main assembly 101 may also be the order different from the order of 8*y*, 8*m*, 8*c*, 8*k* from the front side along the X1 direction.

(Structure of Toner Supplying Unit in Apparatus Main Assembly)

Figure 7A:
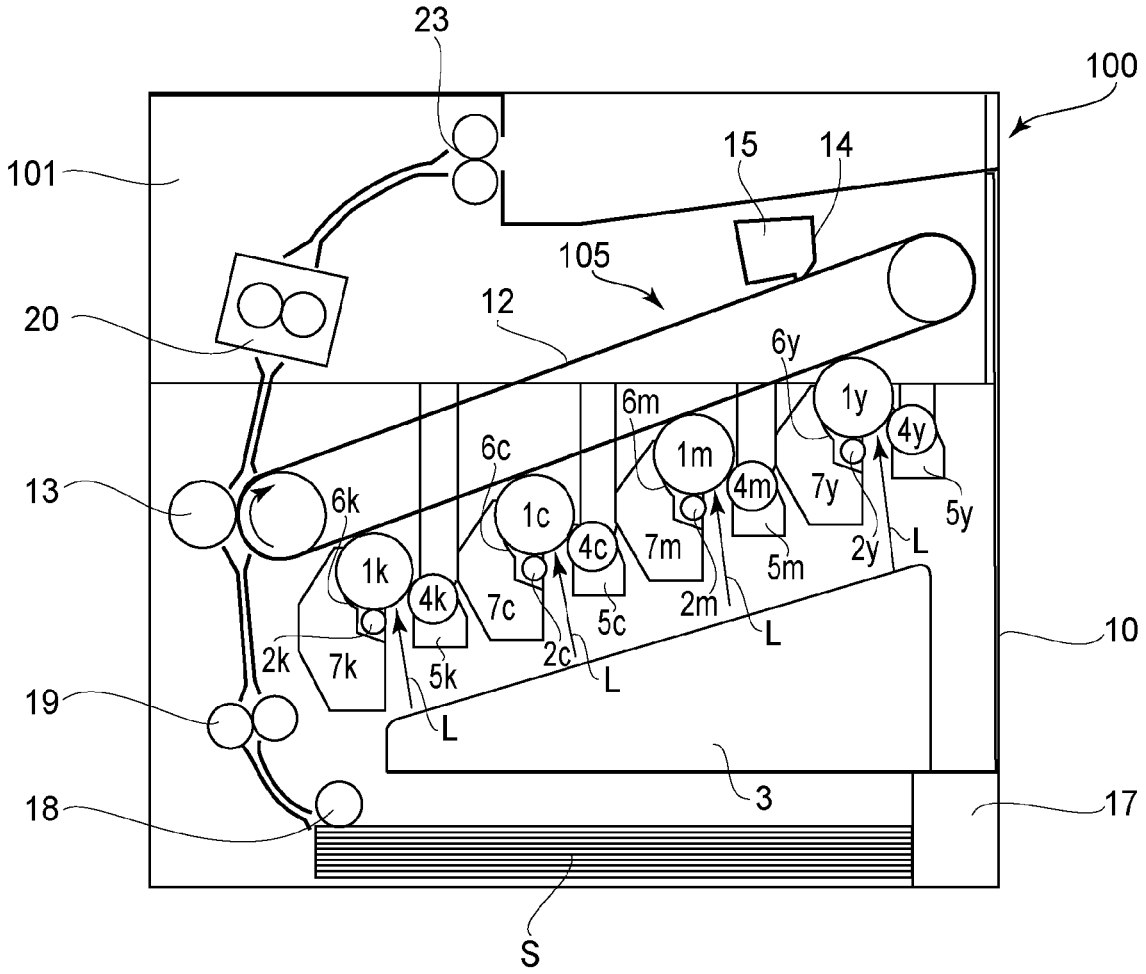
FIG. 7A is a sectional view, from a left side direction, showing an image forming apparatus according to a Second Embodiment.
Figure 7B:
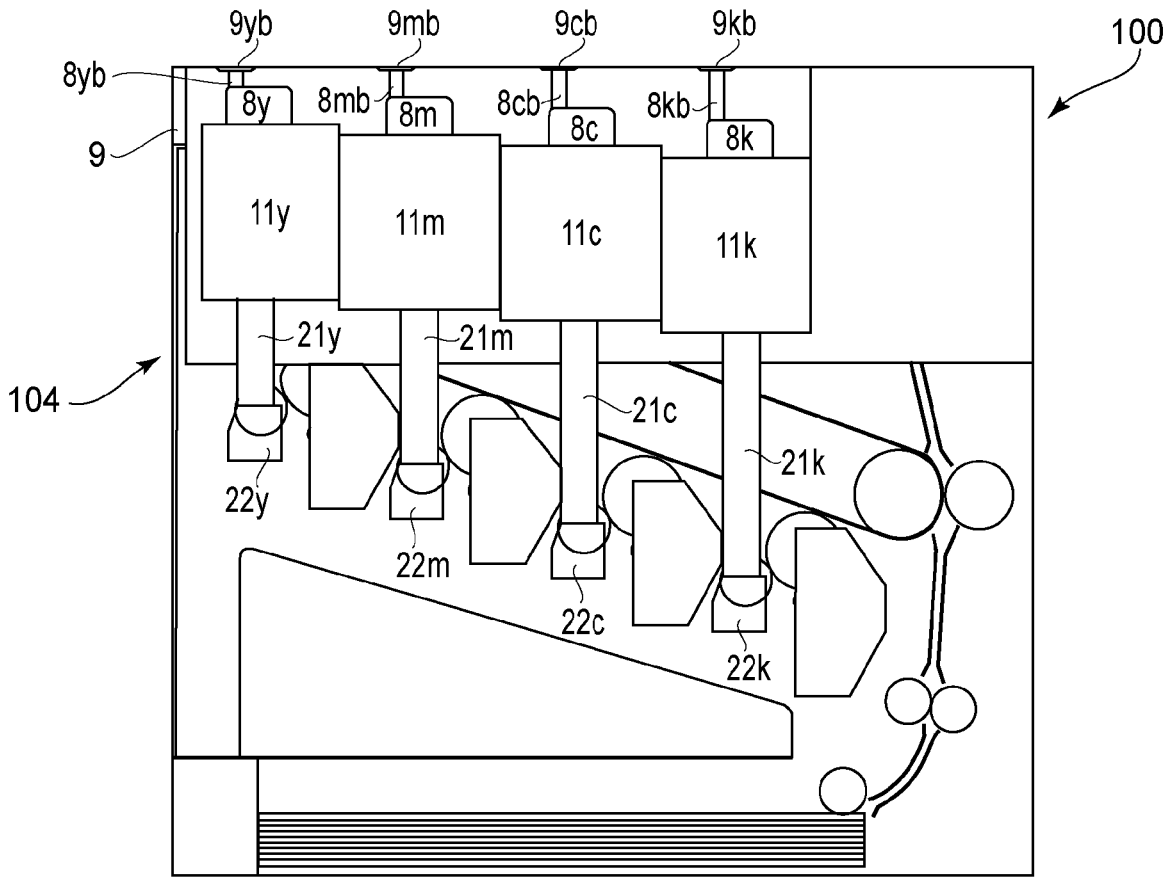
FIG. 7B is a sectional view, from a right side direction, showing the image forming apparatus.

As shown in FIG. 7B, the toner supplying unit 104 includes the mounting portions 11 (11*y*, 11*m*, 11*c*, 11*k*), the toner moving members 21 (21*y*, 21*m*, 21*c*, 21*k*) and the toner feeding portions 22 (22*y*, 22*m*, 22*c*, 22*k*).

Figure 12:
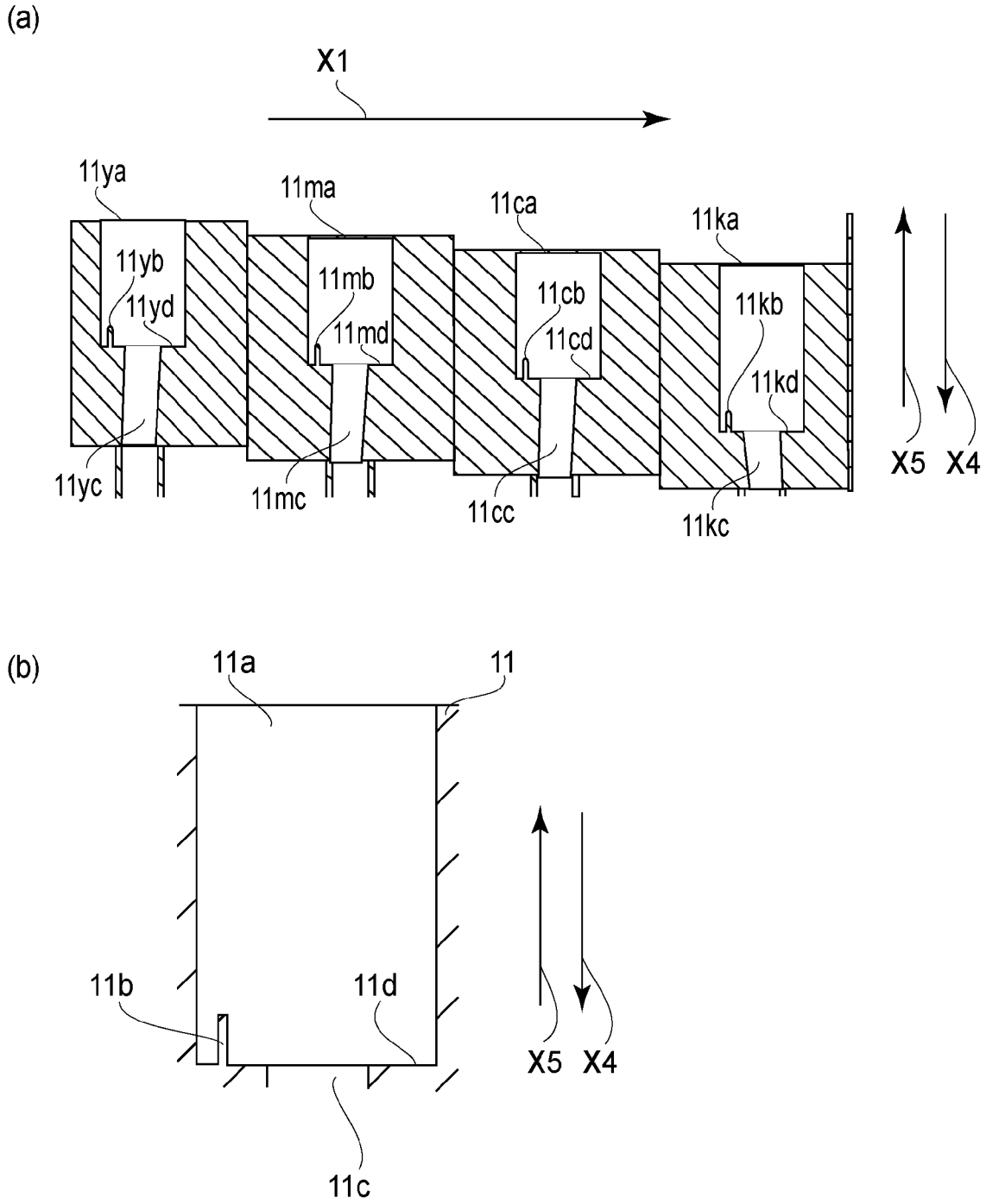
In FIG. 12, (a) is a sectional view, from the right side direction, showing a toner cartridge mounting portion in an unmounted state of the toner cartridge, and (b) is an enlarged sectional view, from the right side direction, showing a mounting location of the toner cartridge in the unmounted state of the toner cartridge.

FIG. 9A is a sectional view of the toner supplying unit 104 when the door 9 is opened, and FIG. 9B is a sectional view of the toner supplying unit 104 when the door 9 is closed. As shown in FIGS. 9A and 9B, mounting positions of the plurality of toner cartridges 8 are different from each other with respect to a mounting direction (for example, a vertical direction) common to the plurality of toner cartridges 8. In FIG. 12, (a) is a sectional view, from a right side direction, of the toner cartridge mounting portion 11 in a state in which the toner cartridges 8 (8*y*, 8*m*, 8*c*, 8*k*) are demounted, and (b) is an enlarged view of the mounting location 11*a* of the toner cartridge mounting portion 11.

As shown in (a) of FIG. 12, at the mounting portions 11, mounting locations 11*a* (11*ya*, 11*ma*, 11*ca*, 11*ka*) are provided in the listed order along the X1 direction so that the toner cartridges 8 are mountable. Further, the 4 mounting portions 11 are disposed and shifted with respect to the X4 direction, and correspondingly also the mounting locations 11*a* are disposed and shifted with respect to the X5 direction. Incidentally, in this embodiment, the mounting location 11*ya* is disposed at a highest position with respect to the X5 direction and the mounting location 11*ka* is disposed at a lowest position with respect to the X5 direction, but different mounting locations may also be disposed at the highest position or the lowest position.

At bottoms 11*d* (11*yd*, 11*md*, 11*cd*, 11*kd*) of the mounting portion 11*a*, the toner cartridge engaging portions 11*b* (11*yb*, 11*mb*, 11*cb*, 11*kb*) are provided, respectively. Further, toner discharge openings 11*c* (11*yc*, 11*mc*, 11*cc*, 11*kc*) are provided.

When the toner cartridges 8 are mounted into the mounting locations 11*a* along the X4 direction, the engaging portions 11*b* engage with the portion-to-be-engaged 8*l* (81*yl*, 81*ml*, 81*cl*, 81*kl*). Then, when the toner cartridges 8 are further mounted into the mounting locations 11*a*, the engaging portions 11*b* penetrate through the portion-to-be-engaged 8*l* and are contactable to the toner cartridge shutters 8 (8*yd*, 8*md*, 8*cd*, 8*kd*).

Further, a size of each of the engaging portions 11*b* with respect to the X5 direction is not particularly limited, but may only be required to be constituted in the following manner. That is, as shown in (a) of FIG. 10, in a state in which the engaging portion 11*b* and the portion-to-be-engaged 8*l* of the toner cartridge 8 are sufficiently engaged with each other, the size of the engaging portion 11*b* may only be required to be a length in which the engaging portion 11*b* is capable of pushing up the shutter 8*d* in the X5 direction to the extent that the gap 8*u* is capable of permitting movement of the toner from the toner accommodating portion 8*g* toward the opening 8*b*.

Incidentally, a portion of engagement between the engaging portion 11*b* and the portion-to-be-engaged 8*l* has a snap-fit constitution, so that, the toner cartridge 8 can be sufficiently mounted into the mounting location 11*a* by applying a certain force or more in the X4 direction. Further, as shown in FIG. 9A, each of the toner discharge openings 11*c* has a constitution provided with a slope with respect to the X4 direction, so that the toner easily drops through the toner discharge opening 11*c*.

As shown in FIGS. 9A and 9B, the toner moving members 21 are provided between the mounting portions 11 and the toner feeding portions 22. Upper surfaces of the toner moving members 21 are in a contact state with a lower surface of the mounting portion 11, and lower surfaces of the toner moving members 21 are in a contact state with upper surfaces of the toner feeding portions 22.

The toner moving members 21 are provided with toner drop openings 21*a* (21*ya*, 21*ma*, 21*ca*, 21*ka*) at insides thereof, so that the toner can be dropped in the X4 direction through each of the toner drop openings 21*a*.

Here, the toner discharge openings 11*c* of the mounting portion 11, the toner drop openings 21*a* of the toner moving members 21 and toner receiving openings 22*a* (22*ya*, 22*ma*, 22*ca*, 22*ka*) of the toner feeding portions 22 are provided so as to overlap with each other with respect to the X1 direction. For this reason, the toner can be dropped from the mounting portions 11 to the toner feeding portions 22. Incidentally, lengths of the toner moving members 21 with respect to the X4 direction are made different depending on associated colors of the toners.

As shown in FIGS. 9A and 9B, each of the toner moving members 21 is provided with the toner receiving opening 22*a* at an upper portion thereof, so that the toner is fed into the toner feeding portion 22 through the toner receiving opening 22*a*. Further, the toner feeding portion 22 is connected with the toner accommodating portion 5, and the toner is fed to the toner accommodating portion 5 by an inside screw (not shown).

(Structure of Door for Toner Cartridge Exchange)

A door 9 in this embodiment is similar to the door 9 in the First Embodiment. That is, as shown in FIG. 1, at an upper surface of the door 9, a handle 9*a* is provided. A user holds the handle 9*a* to open and close the door 9, so that the door 9 rotates about a hinge shaft (not shown), and thus the door 9 can be placed in a closed state as shown in FIG. 1 or in an open state as shown in FIG. 8.

As shown in FIG. 8, FIG. 9B and (a) of FIG. 11, at a lower surface of the door 9, grip portion urging portions 9*b* (9*yb*, 9*mb*, 9*cb*, 9*kb*) are provided. Each of the urging portions 9*b* has a rectangular shape as seen from a right side direction or a front surface direction, but may also have another shape if the urging portion 9*b* is capable of smoothly contacting the toner cartridge 8.

The grip portion urging portion 9*b* may also be constituted by an elastically deformable material so as not to break the toner cartridge 8 when the door 9 is closed and the urging portion 9*b* contacts the toner cartridge 8. Incidentally, when the inner surface of the door 9 is constituted by a material capable of absorbing an impact and a contact noise at the time of contact thereof with the grip portions 8*j* (8*yj*, 8*mj*, 8*cj*, 8*kj*), the grip portion urging portions 9*b* may also not be disposed, but the door 9 may directly contact the grip portions 8*j*.

(During Mounting of Toner Cartridge)

A state before the toner cartridge 8*y* is mounted into the apparatus main assembly 101 is shown in (a) of FIG. 11. In a state in which the door 9 is sufficiently opened, the toner cartridge 8*y* can be mounted into the mounting location 11*ya* of the mounting portion 11 in parallel to the X4 direction. In the following, using (a) and (b) of FIG. 10 and (b) of FIG. 12, mounting of the toner cartridge 8 will be described.

The user grips the grip portion 8*j* and gradually inserts the toner cartridge 8 into the mounting location 11*a* ((b) of FIG. 12). When the toner cartridge 8 is inserted to a certain degree or more, the portion-to-be-engaged 8*l* and the engaging portion 11*b* are in contact with each other, and therefore the user removes his (her) hand in that state. In this contact state, even when the user removes his (her) hand, the engaging portion 11*b* and the portion-to-be-engaged 8*l* have a constitution in which these portions are engaged with each other in a snap-fit shape, and therefore are not sufficiently engaged with each other in a state in which an external force does not generate with respect to the X4 direction.

All of the toner cartridges 8 are placed in the mounted state into the mounting portions as described above, and then the door 9 is gradually closed. In this state, the grip portions 8*j* are disposed at the second position. When the door 9 is closed to a certain degree or more, the grip portion urging portions 9*b* contact the upper surfaces of the upper grip portions 8*r* of the grip portions 8*y* of the toner cartridges 8. From that state, when the door 9 is further closed, the external force exerted on the grip portions 8*j* generates with respect to the X4 direction, so that the external force is transmitted to the elastic members 8*q* through the grip portions 8*j*. By this external force, the elastic members 8*q* are elastically deformed and start to contrast.

When each of the elastic members 8*q* contracts to some extent or more, the portion-to-be-engaged 8*l* and the engaging portion 11*b* start to engage each other. When the door 9 is further closed, the portion-to-be-engaged 8*l* and the engaging portion 11*b* sufficiently engage with each other, so that the portion-to-be-engaged 8*l* penetrates through the casing 8*a*, and contacts the shutter urging portion 8*e* for the shutter 8*d* provided inside the casing 8*a*. From this state, when the grip portion 8*j* is further pushed in, simultaneously with further contraction of the elastic member 8*q*, the external force is transmitted to the elastic member 8*q* through the shutter urging portion 8*e*, and therefore also the elastic member 8*h* starts to contract. As a result, the shutter 8*d* starts to move in the X5 direction relative to the casing 8*a*.

Then, in a state in which the door 9 is sufficiently closed, as shown in (b) of FIG. 10, the elastic member 8*q* is pushed down until the lower grip portion 8*q* of the grip portion 8*j* is in a contact state with the grip portion contact portion 8*s*. Thus, the grip portion 8*j* is in a state in which the grip portion 8*j* is disposed at the first position where the grip portion 8*j* is accommodated sufficiently in the grip portion accommodating portion 8*n*. Further, when the elastic member is pushed up with an increasing degree of the gap 8*u* from the casing 8*a*, the shutter 8*d* is in a moved state.

By the generation of the gap 8*u* as described above, the toner passes from the toner accommodating portion 8*g* of the toner cartridge 8 through the gap 8*u* and the opening 8*b*, so that the toner is capable of being supplied to the outside of the toner cartridge 8. In this state, mounting of the toner cartridge 8 into the mounting portion 11*a* is completed, so that the image forming apparatus 100 is capable of forming the image.

Incidentally, in this embodiment, an example in which when the user closes the door 9, the toner cartridge 8 is sufficiently mounted, from such an insufficient mounted state that the toner cartridge 8 is only placed on the mounting portion 11*a*, by a closing operation of the door 9 was shown. Here, even when the user pushes in the grip portion 8*j* and then pushes in the door 9 from the sufficiently engaged state between the engaging portion 11*b* and the portion-to-be-engaged 8*l*, the toner cartridge 8 can also be placed similarly in the sufficiently mounted state. Further, in the constitution in this embodiment, in order to mount the toner cartridge 8 into the mounting portion 11*a*, there is a need to apply a certain external force or more for placing the toner cartridge 8 in the sufficiently mounted state by closing the door 9 to cause the grip portion 8*j* to be urged by the elastic members 8*h* and 8*q* in the X5 direction.

(During Demounting of Toner Cartridge)

Next, a state in which the toner cartridge 8 is demounted from the apparatus main assembly 101 will be described. In this step, the above-described mounting process of the toner cartridge 8 into the apparatus main assembly 101 is reversely performed.

Before the toner cartridge 8 is exchanged, as shown in (b) of FIG. 10, the toner cartridge 8 is sufficiently mounted into the mounting portion 11, and the image forming apparatus 100 is in an image formable state. The external force exerted on the door 9 generates with respect to the X5 direction from the elastic members 8*q* (8*yq*, 8*mq*, 8*cq*, 8*kq*) through the grip portions 8*j*, but a force for closing the door 9 is larger than the external force, and therefore the door 9 is in a sufficiently closed state. Further, the grip portions 8*j* are in a state in which the grip portions 8*j* are disposed at the first position where the grip portions 8*j* are urged by the door 9 and are accommodated inside the apparatus main assembly.

From this state, when the user holds the handle 9*a* and gradually opens the door 9, the elastic member 8*q* returns to a natural length, and therefore in a state in which the grip portion 8*j* contacts the grip portion urging portion 9*b* ((b) of FIG. 10), the elastic member 8*q* starts to expand in the X5 direction. When the door 9 is opened to a certain degree or more from the contact state, the upper portion 8*r* of the toner cartridge grip portion 8*j* is spaced from the grip portion urging portion 9*b* ((b) of FIG. 10).

Then, as shown in (a) of FIG. 10, the lower portion 8*p* of the grip portion 8*j* is in a contact state with the casing 8*a*, and therefore at least a part of the toner cartridge 8 mounted into the mounting portion 11 is in the second position (maximum expansion position of the elastic member 8*q*) where the part is exposed (projected) to the outside of the apparatus main assembly.

Incidentally, also in a state in which the door 9 is opened, the portion-to-be-engaged 8*l* of the toner cartridge 88 and the engaging portion 11*b* of the mounting portion 11 are in the engaged state by snap fitting. For this reason, the elastic member 8*h* is kept in an urged state in the X4 direction, and the door 9 is displaced in the X5 direction relative to the casing 8*a* similarly as in the case before the door 9 is opened, so that also the gap 8*u* is generated.

Further, when the user grips the grip portion 8*j* and gradually takes out the toner cartridge 8 in the X5 direction, the shutter urging portion 8*e* of the toner cartridge 8 is gradually spaced from the engaging portion 11*b* of the mounting portion 11.

For this reason, an amount of contraction of the elastic member 8*h* connecting the shutter 8*d* and the toner cartridge supporting portion 8*f* becomes small.

As a result, the elastic member 8*h* expands in the X4 direction, and also the shutter 8*d* is moved in the X4 direction relative to the casing 8*a*, so that the gap 8*u* gradually narrows (closes).

Then, when the toner cartridge 8 is gradually demounted along the X5 direction, contact between the engaging portion 11*b* and the shutter urging portion 8*e* is eliminated and the shutter 8*d* returns to a predetermined position, so that a state in which the gap 8*u* is eliminated is formed and a state in which the toner cartridge opening 8*b* is sufficiently closed is formed. As a result, when the toner cartridge 8 is taken out to the outside of the apparatus main assembly 101, it is possible to prevent the toner inside the toner cartridge casing 8*a* from leaking out to the outside of the casing 8*a*.

Thereafter, when the toner cartridge 8 is further be mounted in the X5 direction, also engagement between the engaging portion 11*b* and the portion-to-be-engaged 8*l* is eliminated (disengaged), so that the toner cartridge 8 can be sufficiently demounted from the mounting location 11*a*.

<Third Embodiment>

Figure 13A:
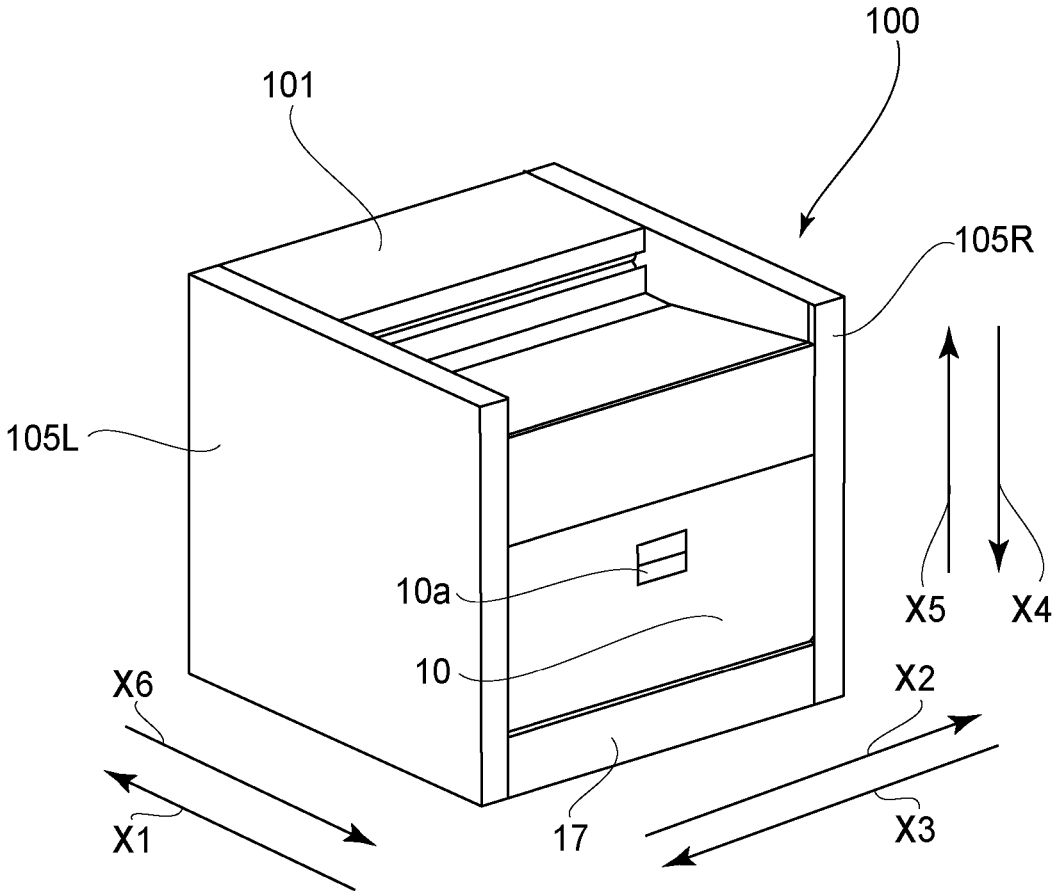
FIG. 13A is a perspective view of an outer appearance of an image forming apparatus according to a Third Embodiment.
Figure 13B:
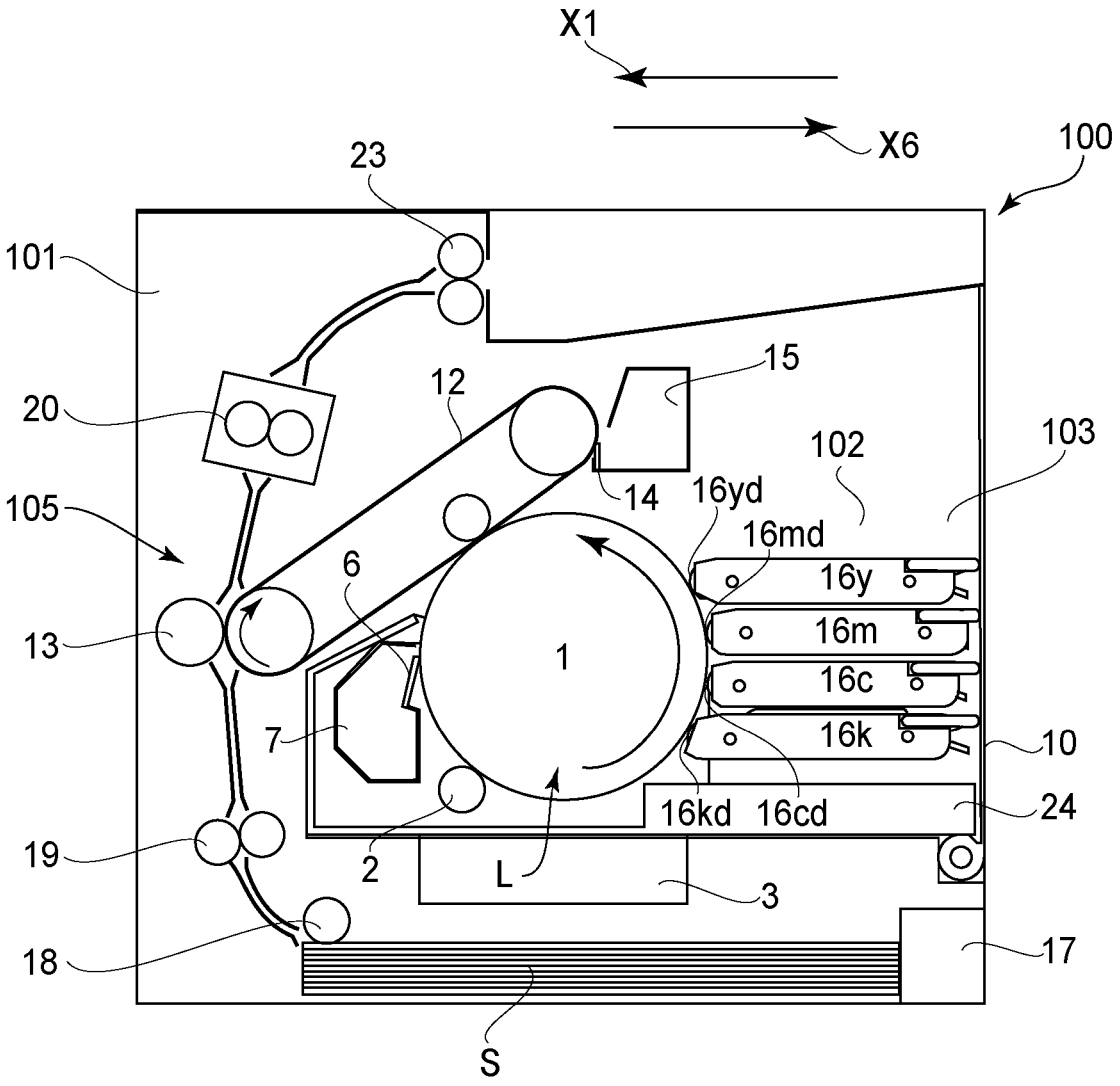
FIG. 13B is a sectional view, from a left side direction, showing the image forming apparatus.

An image forming apparatus 100 in this embodiment is shown in FIGS. 13A and 13B. First and Second Embodiments relate to the type in which the toner cartridges were exchanged, but this embodiment relates to a type in which developing cartridges as developing devices including developing rollers are exchanged. Further, in this embodiment, similarly as in the Second Embodiment, a constitution in which in interrelation with the opening and closing of the door, only the grip portion of the cartridge is displaced but the mounting portion (cartridge mounting portion) is not displaced is employed. An apparatus main assembly 101 in this embodiment is a portion obtained by removing a drum cartridge 24 and developing cartridges 16 (16*y*, 16*m*, 16*c*, 16*k*) from the image forming apparatus 100.

As shown in FIG. 13A, a constitution in which an image is formable in a state in which the drum cartridge 24 and the developing cartridges 16 are mounted in the apparatus main assembly 101 is employed. The drum cartridge 24 includes a photosensitive drum 1, a charger 2, a drum cleaning device 6 and a residual toner container 7. The photosensitive drum 1 is electrically charged at a surface thereof by the charger 2 and is exposed to laser light L, on the basis of image information, by an exposure device 3, so that electrostatic images are formed.

The electrostatic latent images are developed as toner images by developing rollers 16*d* (16*yd*, 16*md*, 16*cd*, 16*kd*) of the developing cartridges 16 which are the developing devices with toners, of respective colors of yellow, magenta, cyan, black, supplied from toner accommodating portions 5 (not shown). The toner images obtained by developing the electrostatic latent images are primary-transferred onto an intermediary transfer belt 12 of an intermediary transfer unit 105. Transfer residual toners remaining on the photosensitive drum 1 after the primary transfer are removed by the drum cleaning device 6 and then are accommodated in the residual toner container 7.

(Exchange of Developing Cartridge)

Figure 15A:
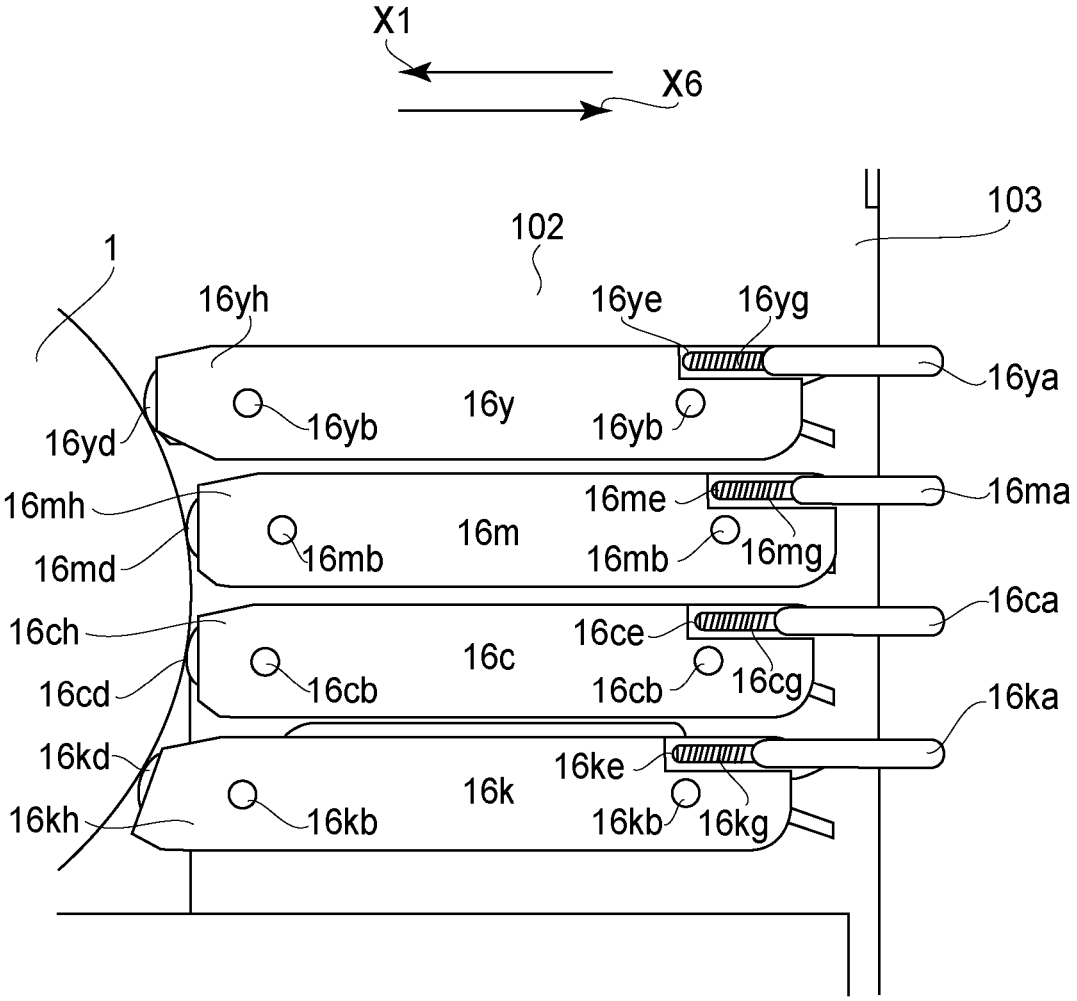
FIG. 15A is a sectional view, from the left side direction, showing a developing cartridge mounting portion in a state in which the door is opened.
Figure 17:
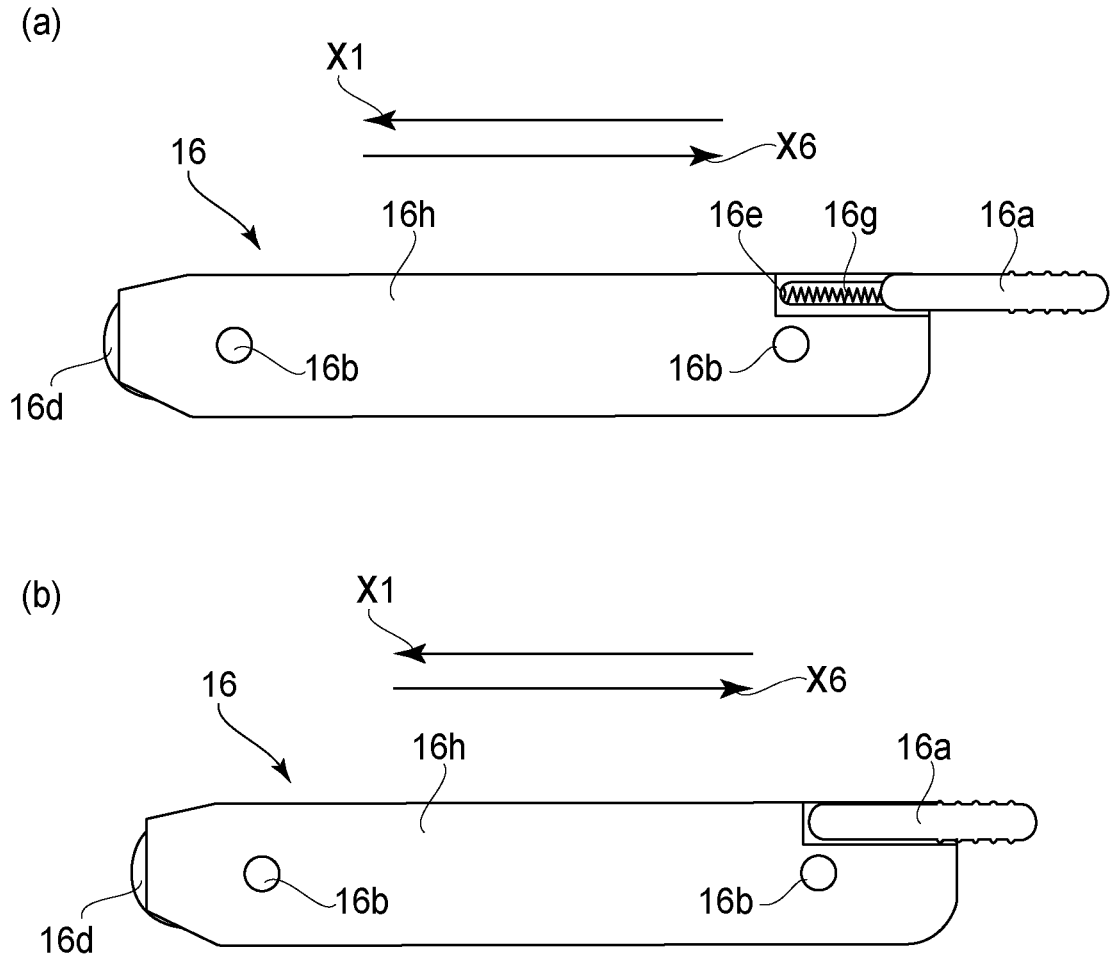
In FIG. 17, (a) is a left side view of the developing cartridge in a state in which a grip portion in the Third Embodiment is in a second position, (b) is a left side view of the developing cartridge in a state in which the grip portion is in a first position.

A left side view of the developing cartridges 16 when no external force exerted on the developing cartridges 16 is generated is shown in each of FIG. 15A and (a) of FIG. 17. Each of the developing cartridges 16 is constituted by a casing 16*h*, a portion-to-be-guided 16*b*, the developing roller 16*d*, a grip portion 16*a* (16*ya*, 16*ma*, 16*ca*, 16*ka*), an elastic member 16*g* as an expansion and contraction member and a grip portion guiding portion 16*e*.

Figure 19:
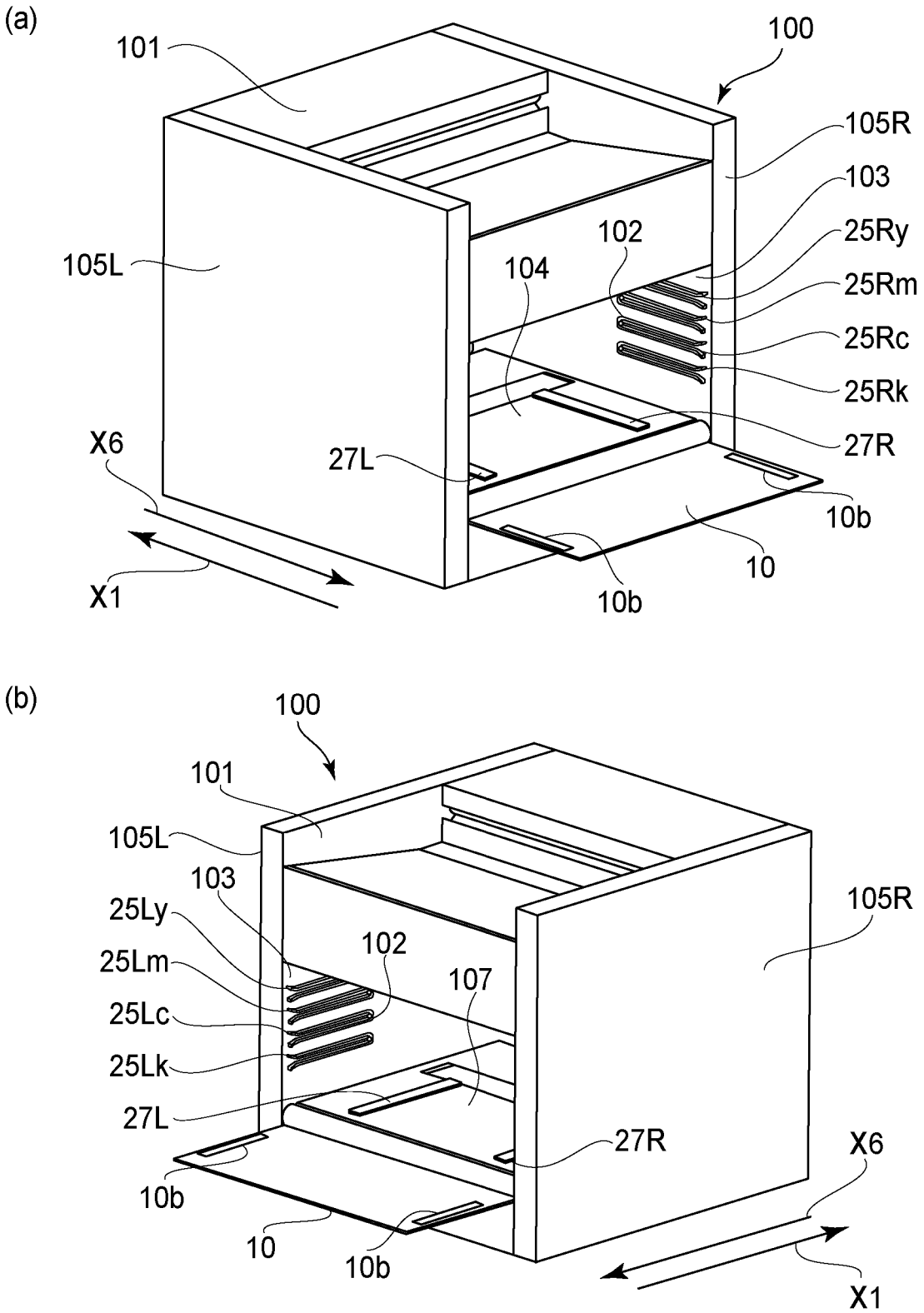
In FIG. 19, (a) is a perspective view, from a left direction, showing the developing cartridge mounting portion in a state in which the door of the image forming apparatus is opened and then the developing cartridge is demounted, and (b) is a perspective view, from a left direction, showing the developing cartridge mounting portion is demounted.

As shown in (a) and (b) of FIG. 19, 4 sets of developing cartridge guides 25R, 25L each extending in the horizontal direction are provided opposed to each other at inner surfaces of a right side frame 105R and a left side frame 105L of the apparatus main assembly 101. The developing cartridge guides 25R, 25L are constituted so that the photosensitive drum 1 is positioned in front of the developing cartridge guides 25R, 25L in a state in which the developing cartridges 16 are mounted into a developing cartridge mounting portion 102. Each of the developing cartridges 16 is detachably mountable to the mounting portion 102 by being guided at portions-to-be-guided 16Rb, 16Lb along guide rails 25R, 25L in a front-rear direction (arrow X1, X6 directions).

Figure 15B:
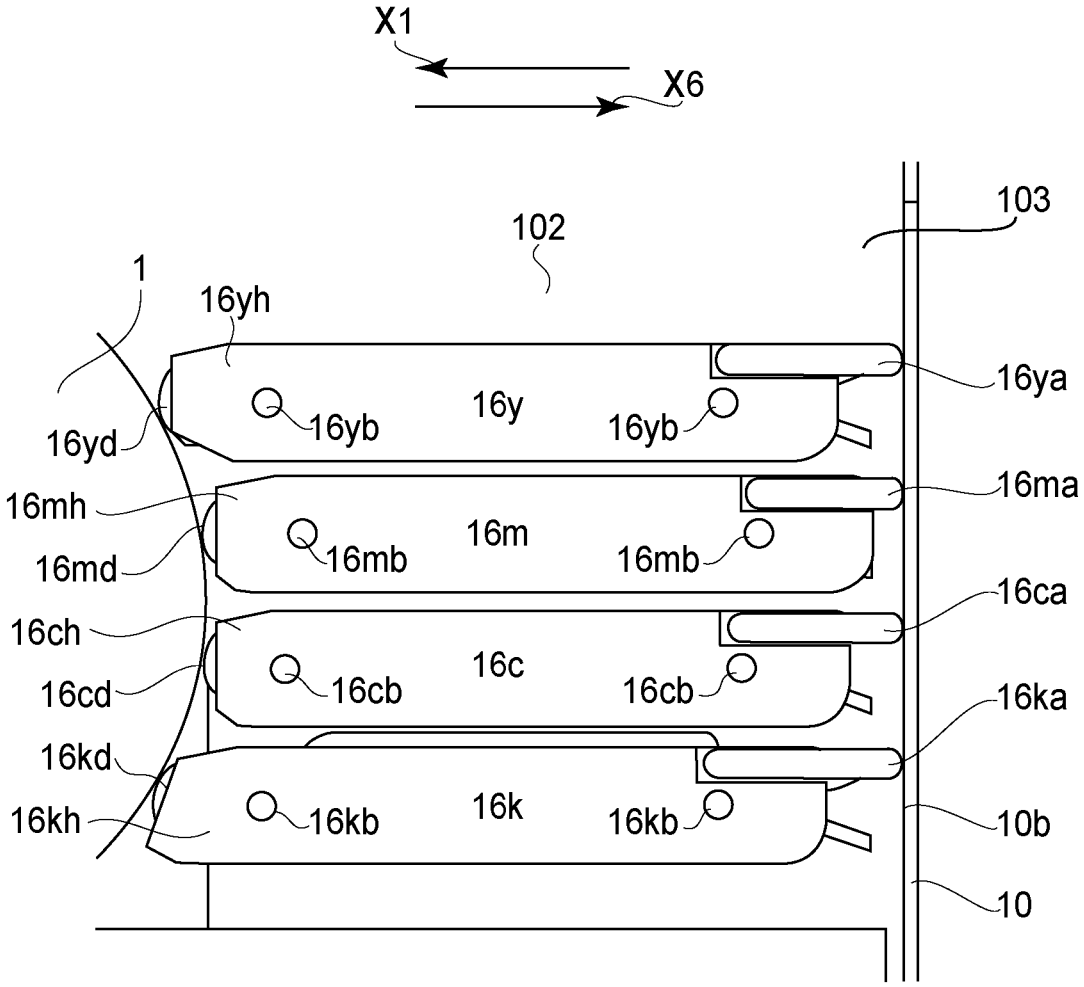
FIG. 15B is a sectional view, from the left side direction, showing the developing cartridge mounting portion in a state in which the door is closed.
Figure 20:
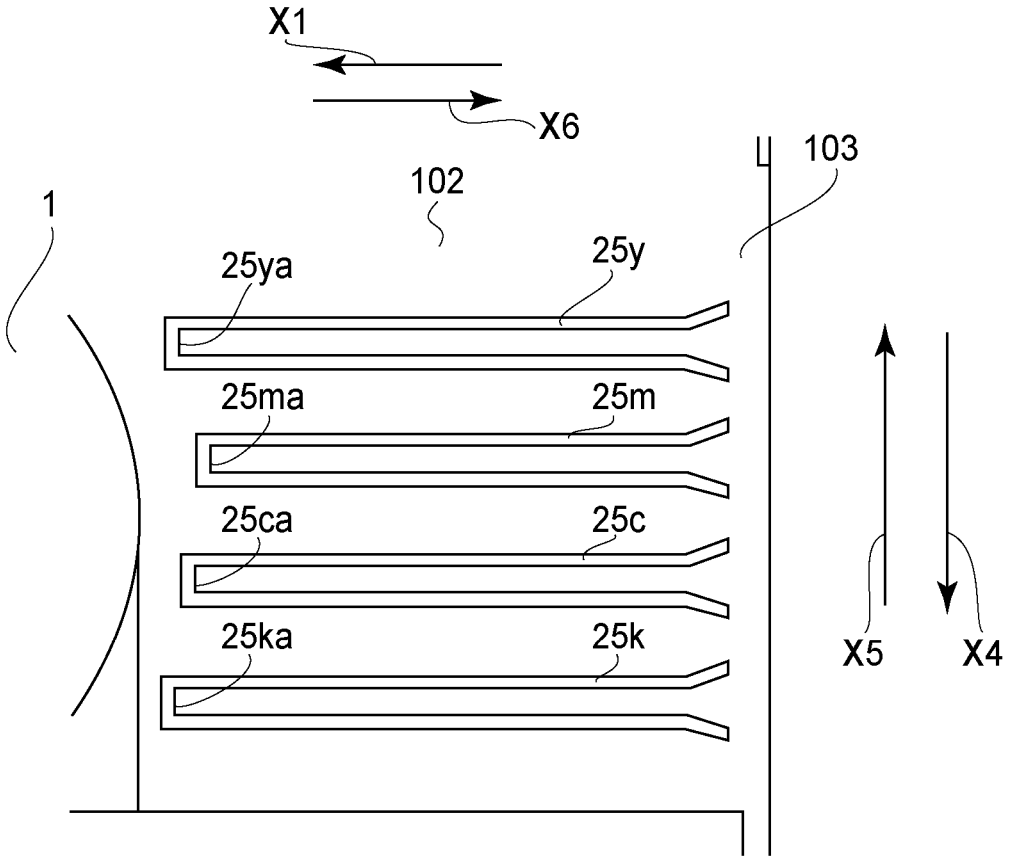
FIG. 20 is a sectional view, from the left side direction, showing the developing cartridge mounting portion.

Incidentally, as shown in (a) and (b) of FIGS. 15A and 15B, the developing cartridges 16 are disposed so that casings 16*h* (16*yh*, 16*mh*, 16*ch*, 16*kh*) are in different positions with respect to the X1 direction relative to the apparatus main assembly 101. Correspondingly, as shown in FIG. 20, also abutting portions 25*a* (25*ya*, 25*ma*, 25*ca*, 25*ka*) of the developing cartridge guides 25 (25*y*, 25*m*, 25*c*, 25*k*) of the mounting portion 102 are similarly disposed at different positions with respect to the X1 direction.

Lengths of the casings 16*h* and the grip portions 16*a* with respect to the X1 direction are different from each other, and therefore in the case where the developing cartridges 16 are not mounted to proper locations, a door 10 is not completely closed, so that image formation cannot be effected.

Figure 14:
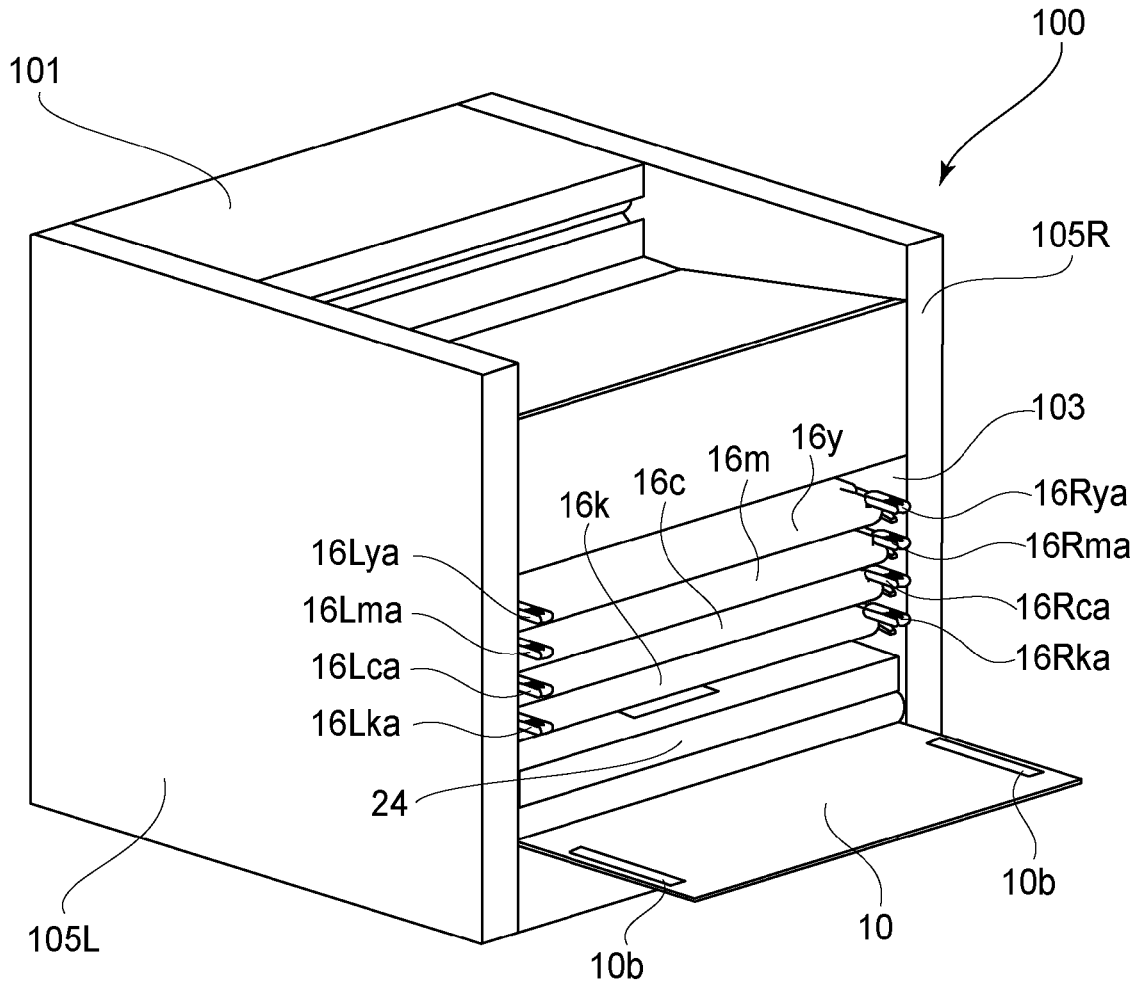
FIG. 14 is a perspective view of an outer appearance of the image forming apparatus in a state in which a door is opened.

When the developing cartridges 16 are exchanged, a demounting operation and a mounting operation of the developing cartridges 16 are performed. In the demounting operation, as shown in FIGS. 14 and 17, the door 10 is opened and then the user grips the grip portions 16Ra, 16La projecting through an opening 103 and moves the developing cartridges 16 from the mounting portion 102 in a demounting direction (X6 direction). Then, the portions-to-be-guided 16*b* (16*yb*, 16*mb*, 16*cb*, 16*kb*) are sufficiently spaced from the developing cartridge guiding portions 25R (25Ry, 25Rm, 25Rc, 25Rk) shown in FIG. 19, and then the developing cartridges 16 are taken out to the outside of the apparatus main assembly 101 and the door is closed.

The mounting operation is performed in reverse order. The user opens the door 10 and then gradually mounts the developing cartridges 16 into the mounting portion 102 in a mounting direction (X1 direction) in a state in which the user grips the grip portions 16Ra, 16La, and pushes the developing cartridges 16 to developing positions, and then closes the door 10. The user performs the mounting and demounting operations while gripping the grip portions 16Ra, 16La, so that there is no need to perform the operations by reaching into the apparatus main assembly 101 with hands, and therefore the user can easily perform the operations.

(Structure of Grip Portion)

In FIG. 17, (a) is a left side view of the developing cartridge 16 in a state in which an external force exerted on the grip portion 16*a* does not generate with respect to the X1 direction, and (b) is a left side view of the developing cartridge in a state in which the external force exerted on the grip portion 16*a* generates with respect to the X1 direction. The grip portion 16*a* is connected with the casing 16*h* by the elastic member 16*g*, so that the grip portion 16*a* can be moved in parallel to the X direction or the X6 direction by a grip portion guiding portion 16*e* shown in (a) and (b) of FIG. 18.

Figure 18:
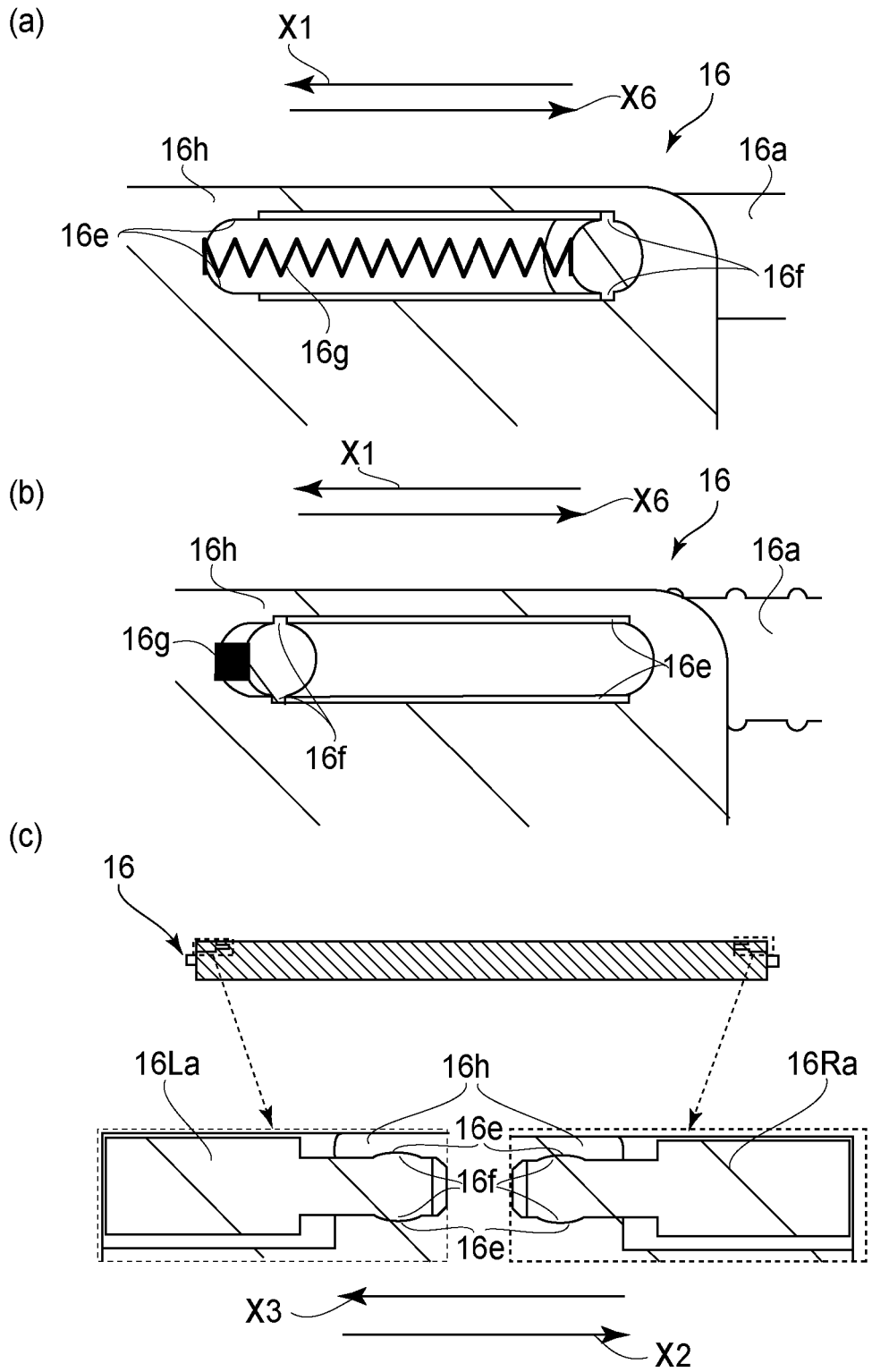
In FIG. 18, (a) is a sectional view, from the left side direction, showing the developing cartridge grip portion in the second position, (b) is a sectional view, from the left side direction, showing the developing cartridge grip portion in the first position, and (c) is a sectional view, from a front (surface) direction, showing the developing cartridge grip portion.

In FIG. 18, (a) and (b) are sectional views, from a left side direction, each showing a portion connecting the grip portion 16*a* and the casing 16*h*, and (c) is a sectional view, from a front (surface) direction, showing the portion connecting the grip portion 16*a* and the casing 16*h*.

As shown in FIG. 18, the grip portion 16*a* is provided with a portion-to-be-guided 16*f*, and the casing 16*h* is provided with the grip portion guiding portion 16*e* capable of guiding the portion-to-be-guided 16*f*. For that reason, the grip portion 16*a* is movable between a most contracted position ((b) of FIG. 18) of the elastic member 16*g* and a most expanded position ((a) of FIG. 18) of the elastic member 16*g*.

Thus, as shown in FIGS. 15 and 18, in the case where the developing cartridge 16 is mounted in the apparatus main assembly 101, the grip portion 16*a* is in a first position (FIG. 15B, (b) of FIG. 18) when the door 10 is closed and is in a second position (FIG. 15A, (a) of FIG. 18) when the door 10 is open.

Here, as shown in (a) of FIG. 17, the elastic member 16*g* connecting the grip portion 16*a* and the casing 8*h* is an urging spring and always urges the grip portion 16*a* in the X6 direction relative to the casing 8*h*. For that reason, when the external force does not generate, the grip portion 16*a* is always in the second position, but when the external force exerted on the grip portion 16*a* with respect to the X1 direction is generated, the grip portion 16*a* moves relative to the casing 8*h*. When the external force exerted on the grip portion 16*a* is not less than a certain level, the grip portion 16*a* moves to the first position shown in FIG. 13B. Then, from that state, when the external force is removed, by an urging force of the elastic member 16*h*, the grip portion 16*a* automatically moves to the second position.

Incidentally, as shown in (c) of FIG. 18, the lengths of the grip portions 16*a* are different from each other with respect to the X1 direction, and in a state in which the door 10 is open, the developing cartridges 16 are disposed at different positions relative to the apparatus main assembly 101 with respect to the X1 direction. However, the grip portions 16*a* are in a state in which right ends thereof are aligned with each other with respect to the X6 direction, so that the grip portions 16*a* can move to the outside of the apparatus main assembly 101 through the opening 103. For that reason, the user easily grips a desired developing cartridge 16 when the user grips the developing cartridge 16.

(Structure of Door)

As shown in FIG. 13A, the door 10 is provided with a handle 10*a*. The user grips the handle 10*a* and then rotates the handle 10*a* from a closed state of the door 10 to an opened state of the door 10 as shown in FIG. 14. Further, as shown in FIG. 14 and FIG. 15A, the door 10 is provided with grip portion urging portions 10*b* at an inside surface of the apparatus main assembly 101 when the door 10 is closed. In FIG. 14, two grip portion urging portions 10*b* are disposed correspondingly to the left and right grip portions 16Ra, 16La, respectively, and are the same in shape, and are provided at positions where the grip portion urging portions 10*b* contact the associated grip portions 16*a*, respectively.

Incidentally, a material for the grip portion urging portions 10*b* is not particularly defined, but may only be required to be a material capable of absorbing an impact and a contact noise when the grip portion urging portions 10*b* contact the grip portions 16*a*, and for example, may also be an elastic member. In this embodiment, the two grip portion urging portions 10*b* are disposed at left and right positions, but may also be further divided or may also have different shapes as long as the resultant grip portion urging portion 10*b* have similar functions. Incidentally, when the inside surface of the door 10 is constituted by the material capable of absorbing the impact and the contact noise when the inside surface contacts the grip portions 9, the grip portion urging portions 10*b* may also not be provided, and the door 10 may also be directly contacted to the grip portions 16*a*.

(Interrelation Between Door and Grip Portion when Door is Opened)

In this embodiment, when the developing cartridges 16 are mounted in the apparatus main assembly 101, in interrelation with the opening and closing of the door 10, the grip portions 16*a* are moved between the first position and the second position and are disposed at the first position or the second position. In the following, motion of the grip portions 16*a* when the door 10 is opened will be described.

The developing cartridges 16 are, as shown in FIG. 15B, in a state in which the grip portions 16*a* are disposed at the first position when the developing cartridges 16 are mounted in the mounting portion 102 and the door 10 is closed. In this state, the door 10 urges the grip portions 16*a* in the X1 direction through the grip portion urging portions 10*b*. At this time, as shown in (b) of FIG. 18, the portions-to-be-guided 16*f* are in positions closest to downstream ends of the grip portion guiding portions 16*e* with respect to the X1 direction, and urge the casing 16*h* in the X1 direction.

In this state, the portions-to-be-guided 16*f* (16*yf*, 16*mf*, 16*cf*, 16*kf*) shown in FIG. 18 are guided by the developing cartridge guides 25 (25*y*, 25*m*, 25*c*, 25*k*) shown in FIG. 19. In addition, the portions-to-be-guided 16*f* contact the abutting portions 25*a* (25*ya*, 25*ma*, 25*ca*, 25*ka*) shown in FIG. 20. For that reason, the abutting portions 25*a* are in a state in which the abutting portions 25*a* receive the external force from the door 10 through the portions-to-be-guided 16*f* and the casings 16*h*. Incidentally, a state in which the abutting portions 25*a* and the portions-to-be-guided 16*f* are in contact with each other is such a state that the developing cartridges 16 are sufficiently mounted into the mounting portion 102.

Here, each of the developing cartridge guides 25 has a snap-fit mechanism which narrows in width at a periphery of the abutting portion 25*a* where the guides 25 contact the abutting portion 25*a*, and the developing cartridge 16 does not move in the X1 direction without external force with respect to the X1 direction.

Figure 15C:
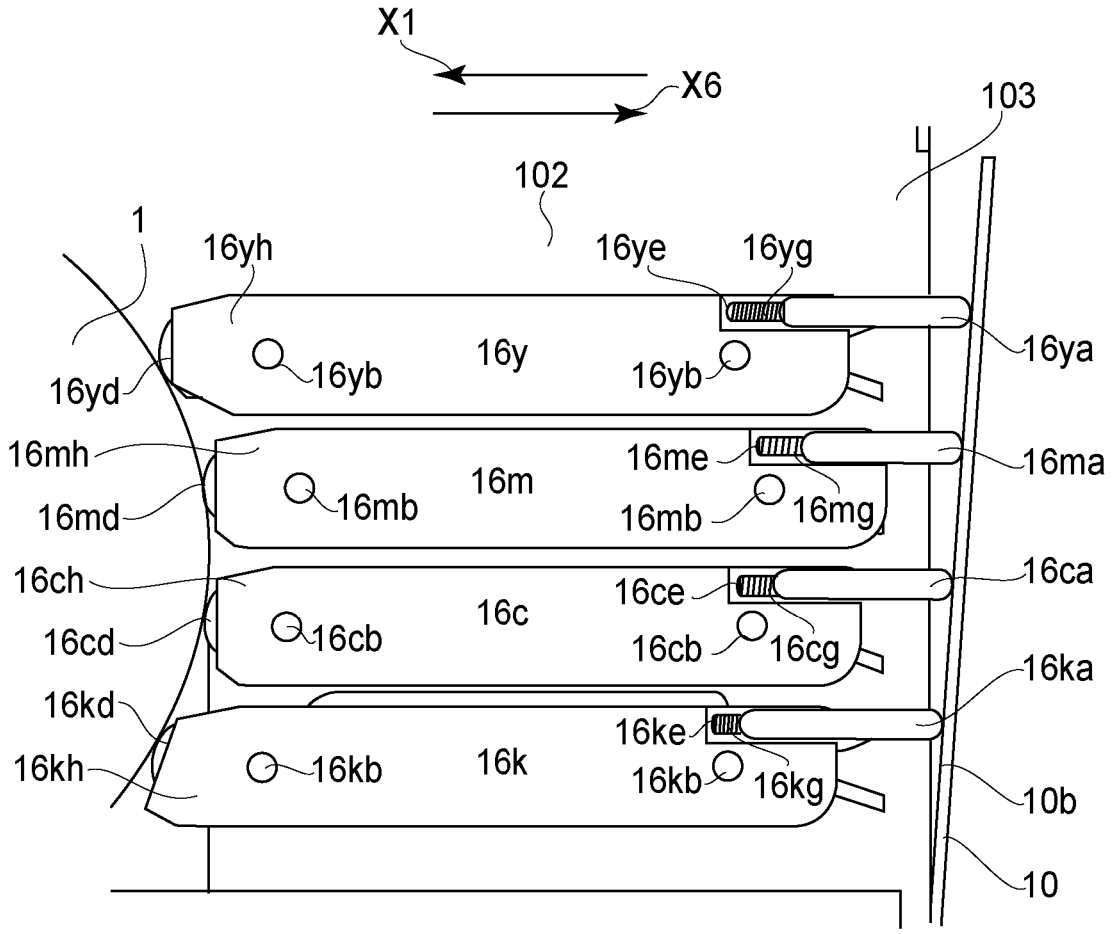
FIG. 15C is a sectional view, from the left side direction, showing the developing cartridge mounting portion in a state in which the door is opened with a certain angle.

In order to place the door 10 from the closed state to the opened state as described above, the door 10 is rotated. FIG. 15C is a sectional view, from the left side direction, of the developing cartridge mounting portion 102 in a state in which the door 10 is opened in a certain degree (amount). The door 10 is opened, whereby the displace urging portions 10*b* urge the grip portions 16*a* and thus a displaced amount decreases. The grip portions 16*a* are urged from the casing 16*h* in the X6 direction through the elastic members 16*g* (16*yg*, 16*mg*, 16*cg*, 16*kg*), and therefore by rotation of the door 10, the grip portions 16*a* move in the X6 direction in a contact state with the grip portion urging portions 10*b*.

Incidentally, a part of the portions-to-be-guided 16*f* is mounted to a part of the developing cartridge guiding portions 25 by snap fitting, and therefore the developing cartridge 16 is disposed at the same position as the position thereof before the door 10 is opened.

Then, the door 10 is further opened and is placed in a sufficiently opened state. FIG. 15A is a sectional view, from the left side direction, of the mounting portion 102 in a state in which the door 10 is rotated and sufficiently opened. When the door 10 is sufficiently opened, urging and displacement which are given from the grip portion urging portions 10*b* to the grip portions 16*a* with respect to the X1 direction are eliminated.

As a result, the grip portions 16*a* are in a state in which only the external force for urging the grip portions 16*a* from the casing 16*h*in the X6 direction is generated, so that the grip portions 16*a* are disposed at the second position where the grip portions 16*a* move in the X6 direction to the maximum. As shown in (a) of FIG. 18, the grip portions 16*a* are in a state in which the grip portions 16*a* move to downstream ends of the grip portion guiding portions 16*e* with respect to the X6 direction. Incidentally, also in this state, the developing cartridge 16 is not moved based on the snap-fit mechanism, and therefore the developing cartridge 16 is disposed at the same position as the position before the door 10 is opened.

Figure 16:
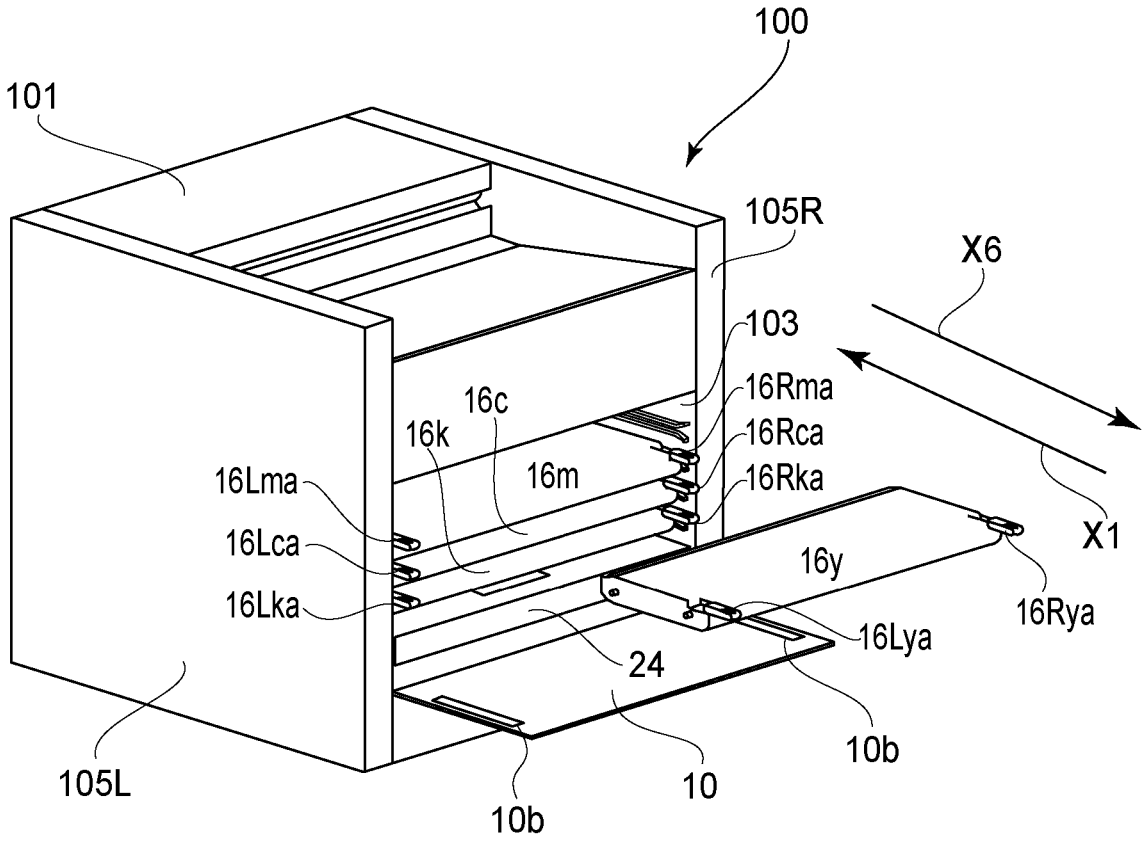
FIG. 16 is a perspective view of an outer appearance of the image forming apparatus before the developing cartridge is mounted into the developing cartridge mounting portion or after the developing cartridge is demounted from the developing cartridge mounting portion.

Thus, the developing cartridge 16 in this embodiment can be demounted from the mounting portion 102. A perspective view of an outer appearance of the image forming apparatus after the developing cartridge 16*y* is removed from the image forming apparatus is shown in FIG. 16.

(Interrelation Between Door and Grip Portion when Door is Closed)

Next, motion of the grip portions 16*a* when the door 10 is closed in a state in which the developing cartridge 16 is sufficiently or insufficiently mounted in the apparatus main assembly 101 will be described. Incidentally, an insufficiently mounted state is such a state that the developing cartridge 16 is mounted in the mounting portion 102, but a part of the portions-to-be-guided 16*b* (16*yb*, 16*mb*, 16*cb*, 16*kb*) does not contact the abutting portion 25*a* of the developing cartridge guiding portion 25.

In the following, first, behavior in a state in which the developing cartridges 16 are sufficiently mounted in the apparatus main assembly 101 will be described. When the developing cartridges 16 are sufficiently mounted in the mounting portion 102 and the door 10 is opened, the developing cartridges 16 are in a state shown in FIG. 15A. In this state, there is no contact of the grip portions 16*a* with the grip portion urging portions 10*b* on the door 10.

For that reason, the grip portions 16*a* are in a state in which only the external force for urging the grip portions 16*a* from the casing 16*h*in the X6 direction through the elastic member 16*g* is generated, so that the grip portions 16*a* are disposed at the second position where the grip portions 16*a* move in the X6 direction to the maximum. Thus, as shown in (a) of FIG. 18, the portions-to-be-guided 16f are in a state in which the portions-to-be-guided 16*f* move to downstream ends of the grip portion guiding portions 16*e* with respect to the X6 direction.

From that state, the door 10 is gradually rotated in a closing direction. When the door 10 is opened to a certain extent or more, the grip portion urging portions 10*b* contact end portions of the grip portions 16*a*. When the developing cartridges 16 are sufficiently mounted in the mounting portion 102, the developing cartridges 16 cannot be further moved in the X1 direction. For that reason, when the grip portions 16*a* are further urged from that state in the X1 direction with the grip portion urging portions 10*b* by rotation of the door 10, the elastic member 16*g* contracts in the X1 direction, and therefore as shown in FIG. 15C, the grip portions 16*a* start to move in the X1 direction.

As shown in FIG. 15B, the grip portions 16*a* are disposed at the first position when the door 10 is sufficiently closed. In this state, the door 10 urges the grip portions 16*a* in the X1 direction through the grip portion urging portions 10*b*. At this time, as shown in (b) of FIG. 18, the portions-to-be-guided 16*f* are in positions closest to downstream ends of the grip portion guiding portions 16*e* with respect to the X1 direction, and are in a state in which the portions 16*f* urge the casing 16*h* in the X1 direction.

Next, behavior in a state in which the developing cartridges 16 are not sufficient mounted in the mounting portion 102 will be described. In the case where the developing cartridges 16 are not sufficiently mounted in the mounting portion 102 and the door 10 is opened, different from the case where the developing cartridges 16 are sufficiently mounted in the mounting portion 102, the grip portions 16*a* are in a state in which the grip portions 16*a* are not aligned with each other with respect to the X6 direction.

From that state, when the door 10 is gradually rotated in the closing direction, similarly as in the case where the developing cartridges 16 are sufficiently mounted in the mounting portion 102, when the door 10 is rotated to a certain degree (amount) or more, the grip portion urging portions 10*b* and end portions of the grip portions 16*a* are in contact with each other. However, when the developing cartridges 16 are insufficiently mounted in the mounting portion 102, even after the contact between the grip portion urging portions 10*b* and the end portions of the grip portions 16*a*, by rotating the door 10 in the closing direction, the developing cartridges 16 can be further moved in the X1 direction.

After the contact between the grip portion urging portions 10*b* and the end portions of the grip portions 16*a*, when the door 10 is gradually closed, the developing cartridges 16 are gradually moved in the X1 direction in a state in which the elastic member 16*g* is contracted in a certain amount in the X1 direction by a certain distance. Then, the door 10 is further closed and when the developing cartridges 16 are pushed into the mounting portion 102 in the X1 direction in a certain amount or more, a part of the portions-to-be-guided 16*b* gradually approaches the abutting portions 25*a* (FIG. 20) of the developing cartridge guiding portions 25.

Here, in the neighborhood of the abutting portion 25*a*, the snap-fit mechanism includes the developing cartridge guiding portion 25 where the guiding width narrows. For that reason, a frictional force received by the portions-to-be-guided 16*b* from the developing cartridge guiding portion 25 in the X6 direction increases. Further, a largest frictional force generating when the developing cartridges 16 are mounted is larger than a resisting force generating when all of the grip portions 16*a* are urged from the second position to the first position.

Accordingly, in FIG. 18, as a part of the portions-to-be-guided 16*b* approaches the abutting portions 25*a* (FIG. 20), the elastic member 16*g* contracts in the X1 direction, so that the portions-to-be-guided 16*f* move to positions closest to a downstream end of the grip portion guiding portion 16*g* with respect to the X1 direction. In that state, displacement of the grip portions 16*e* relative to the casing 16*h* is eliminated, and therefore the grip portions 16*a* and the casing 16*h* move together in the X1 direction.

Then, from the door 10, when an external force larger than the frictional force received by the portions-to-be-guided 16*b* from the developing cartridge guiding portion 25 in the X6 direction is applied through the grip portions 16*a* and the casing 16*h*, a part of the portions-to-be-guided 16*b* contacts the abutting portion 25*a*. In this state, as shown in FIG. 15B, the developing cartridges 16 are in a state in which the developing cartridges 16 are sufficiently mounted in the mounting portion 102, and also the door 10 is in a state in which the door 10 is sufficiently closed.

(Modified Embodiments)

In the above-described embodiments, preferred embodiments of the present invention were described, but the present invention is not limited thereto and various modifications can be made within the scope of the present invention. Further, technical matters described in the embodiments mentioned above can also be employed in other embodiments.

According to the present invention, during exchange of the cartridge, the user is capable of exchanging (replacing) the cartridge without reaching into the image forming apparatus main assembly with hand(s), so that the exchanging (replacing) operation can be performed easily.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-103558 filed on May 21, 2015, which is hereby incorporated by reference herein in its entirety.

What is claimed is:

1. An image forming apparatus comprising:

a main assembly; and a cartridge capable of supplying developer and detachably mountable to said main assembly, wherein said main assembly includes a mounting portion for mounting said cartridge and a door for causing said mounting portion to be in an open state and a closed state, wherein said main assembly or said cartridge includes an expansion and contraction member for displacing at least a part of said cartridge, wherein opening and closing of said door is interrelated with expansion and contraction of said expansion and contraction member, wherein in the closed state, said cartridge mounted in said mounting portion is in a first position, inside said main assembly, where an image is formable, wherein in the open state, said cartridge mounted in said mounting portion is in a second position where at least a part thereof projects to an outside of said main assembly, and wherein said cartridge includes a grip portion for being gripped when said cartridge is mounted into and demounted from said main assembly, wherein said expansion and contraction member displaces said grip portion in a state in which said mounting portion is not displaced, and wherein said grip portion is accommodated inside said main assembly at the first position and is projected outside of said main assembly at the second position.

2. An image forming apparatus according to claim 1, wherein said door includes, at an inner surface facing the inside of said main assembly in the closed state, an urging portion for relaxing an impact when said urging portion contacts at least a part of said cartridge projecting outside of said main assembly.

3. An image forming apparatus according to claim 1, wherein a direction of at least a part of said cartridge projecting to the outside of said main assembly is a same direction as a demounting direction of said cartridge.

4. An image forming apparatus according to claim 3, wherein the same direction is a vertical direction.

5. An image forming apparatus according to claim 1, wherein a direction of at least a part of said cartridge projecting to the outside of said main assembly is a horizontal direction.

6. An image forming apparatus according to claim 1, wherein said cartridge includes a plurality of cartridges provided correspondingly to different colors.

7. An image forming apparatus according to claim 6, wherein mounting positions of said plurality of cartridges are different from each other with respect to a common mounting direction of said plurality of cartridges.

8. An image forming apparatus according to claim 1, further comprising a moving member, provided in said main assembly, for moving the developer from said cartridge to said main assembly, wherein said moving member has a bellow shape and is expanded and contracted by said expansion and contraction member.

9. An image forming apparatus according to claim 1, wherein said door includes, at an inner surface facing the inside of said main assembly in the closed state, an urging portion for relaxing an impact when said urging portion contacts at least a part of said cartridge projecting outside of said main assembly.

10. An image forming apparatus, comprising:

a main assembly; and a cartridge capable of supplying developer and detachably mountable to said main assembly, wherein said main assembly includes a mounting portion for mounting said cartridge and a door for causing said mounting portion to be in an open state and a closed state, wherein said main assembly or said cartridge includes an expansion and contraction member for displacing at least a part of said cartridge, wherein opening and closing of said door is interrelated with expansion and contraction of said expansion and contraction member, wherein in the closed state, said cartridge mounted in said mounting portion is in a first position, inside said main assembly, where an image is formable, wherein in the open state, said cartridge mounted in said mounting portion is in a second position where at least a part thereof projects outside of said main assembly, wherein said expansion and contraction member displaces said cartridge mounted in said mounting portion integrally with said mounting portion, and wherein at the second position, said cartridge and said mounting portion are projected outside of said main assembly.

11. An image forming apparatus according to claim 10, further comprising a moving member, provided in said main assembly, for moving the developer from said cartridge to said main assembly, wherein said moving member has a bellow shape and is expanded and contracted by said expansion and contraction member.

12. An image forming apparatus according to claim 10, wherein said cartridge includes a plurality of cartridges provided correspondingly to different colors.

13. An image forming apparatus according to claim 12, wherein mounting positions of said plurality of cartridges are different from each other with respect to a common mounting direction of said plurality of cartridges.

14. An image forming apparatus according to claim 12, further comprising grip portions for being gripped when said plurality of cartridges are mounted into associated mounting portions, wherein a difference in projected position between said grip portions is smaller than a difference in position between the mounting portions with respect to a mounting direction.

15. An image forming apparatus according to claim 14, wherein end portion positions of said grip portions are aligned with a predetermined surface so as to eliminate the difference in projected position between said grip portions.

16. An image forming apparatus according to claim 10, wherein a direction of at least a part of said cartridge projecting to the outside of said main assembly is a same direction as a demounting direction of said cartridge.

17. An image forming apparatus according to claim 16, wherein the same direction is a vertical direction.

18. A cartridge capable of supplying developer and detachably mountable to a main assembly of an image forming apparatus including a mounting portion and a door for causing the mounting portion to be in an open state and a closed state, said cartridge comprising:

a grip portion; and an expansion and contraction member for displacing said grip portion while maintaining said cartridge at a position where said cartridge is mounted in the mounting portion, wherein said grip portion is in a first position where an image is formable inside the main assembly in the closed state and is in a second position where said grip portion projects to an outside of the main assembly in the open state.

19. A cartridge according to claim 18, which is a toner cartridge.

20. A cartridge according to claim 18, which is a developing cartridge including a developing roller.

* * * * *